United States Patent [19]

Zapp

[11] 4,201,489

[45] May 6, 1980

[54] KEYBOARD ACTUATABLE WITH THE AID OF THE FINGERS OF AT LEAST ONE HAND

[75] Inventor: Walter Zapp, Oberegg, Switzerland

[73] Assignee: Creatcchnil Patent AG, Dietliko, Switzerland

[21] Appl. No.: 868,930

[22] Filed: Jan. 12, 1978

Related U.S. Application Data

[63] Continuation-in-part of Ser. No. 729,075, Oct. 4, 1976, Pat. No. 4,081,068.

[30] Foreign Application Priority Data

Aug. 4, 1976 [CH] Switzerland ..... 10048/76

[51] Int. Cl.[2] ..... B41J 5/28

[52] U.S. Cl. ..... 400/485; 400/489; 400/479.2; 400/715; 200/6 A; 200/67 F; 335/207

[58] Field of Search ..... 400/472–474, 400/479, 485, 489, 715, 479.2; 335/207, 188; 200/67 F, 6 A

[56] References Cited

U.S. PATENT DOCUMENTS

| | | | |
|---|---|---|---|
| 1,336,151 | 4/1920 | O'Connor | 400/489 |
| 2,532,228 | 11/1950 | Hesh | 400/485 |
| 2,803,714 | 8/1957 | Hesh | 200/6 A |
| 3,271,532 | 9/1966 | Lopez | 200/6 A |
| 3,452,850 | 7/1969 | Manns | 400/479.2 |
| 3,627,097 | 12/1971 | Plieninger | 400/479 |
| 3,815,066 | 6/1974 | Vinal | 400/479 |
| 3,854,109 | 12/1974 | Gotanda | 335/207 |
| 3,938,642 | 2/1976 | Van Rumpt et al. | 400/496 |
| 4,029,915 | 6/1977 | Ojima | 400/485 |
| 4,054,944 | 10/1977 | Lau | 200/5 E |

FOREIGN PATENT DOCUMENTS 2017063 10/1970 Fed. Rep. of Germany ..... 400/489

OTHER PUBLICATIONS de Graaf et al., *Magnetic Key Unit for keyboard,* IBM Technical Disclosure Bulletin, vol. 21, No. 1, p. 314, 6/78.

*Primary Examiner*—William Pieprz
*Attorney, Agent, or Firm*—Heinrich W. Herzfeld; Gilbert L. Wells

[57] ABSTRACT

A keyboard which has support frame, or several rows of key units. Each key is movable out of an initial inoperative position by the tip of the index finger. The key of each key unit of a guide key row has a key rod and a top face on one end of the key rod. The tip of a finger rests at random pressure on each top face as, at the opposite end of the key rod, a non-depressable mounting is articulatedly lodged in the support frame and prevents downward depression of the key while permitting tilting toward one or more operational positions.

Each key unit of the guide key row has a magnetic pole to exercise a determined initial attraction on the top face-bearing end of the key rod an doppose tilting movement of the key away from the attracting means, when this movement is initiated by a finger tip.

A stop prevents the magnetic pole on the opposite key side from following the tilting movement of the key, whereby the attractive force of the magnetic pole decreases as the distance of the key therefrom increases due to the process of the tilting movement of the key, so that the finger tip continues to tilt the key involuntarily further until the key is fully shifted to the operational position.

19 Claims, 22 Drawing Figures

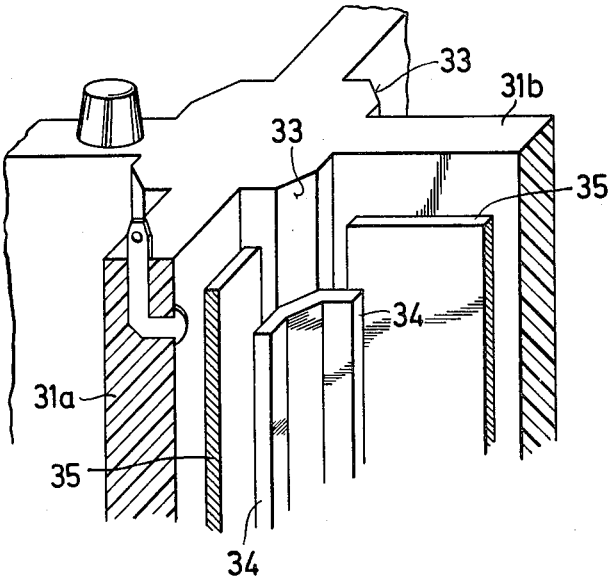
Fig. 8
Fig. 9
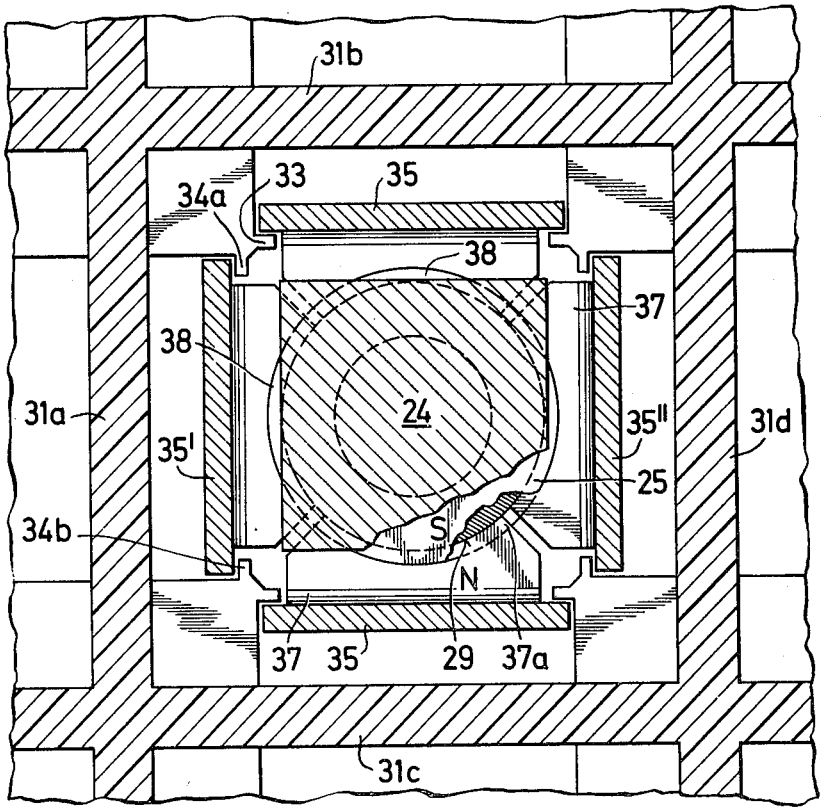

Fig. 10A
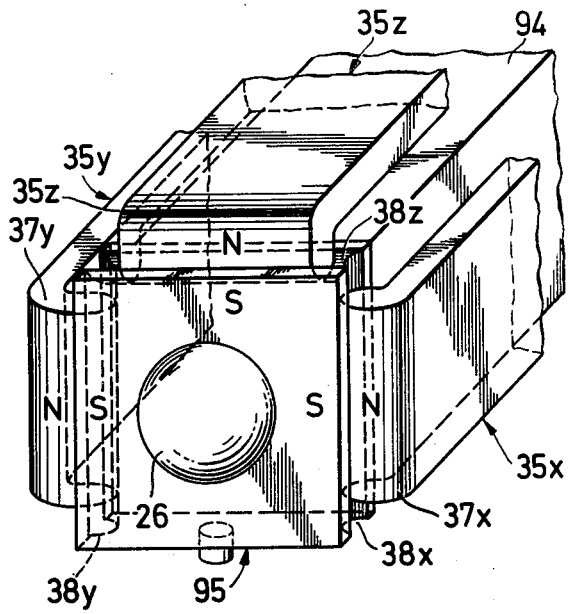
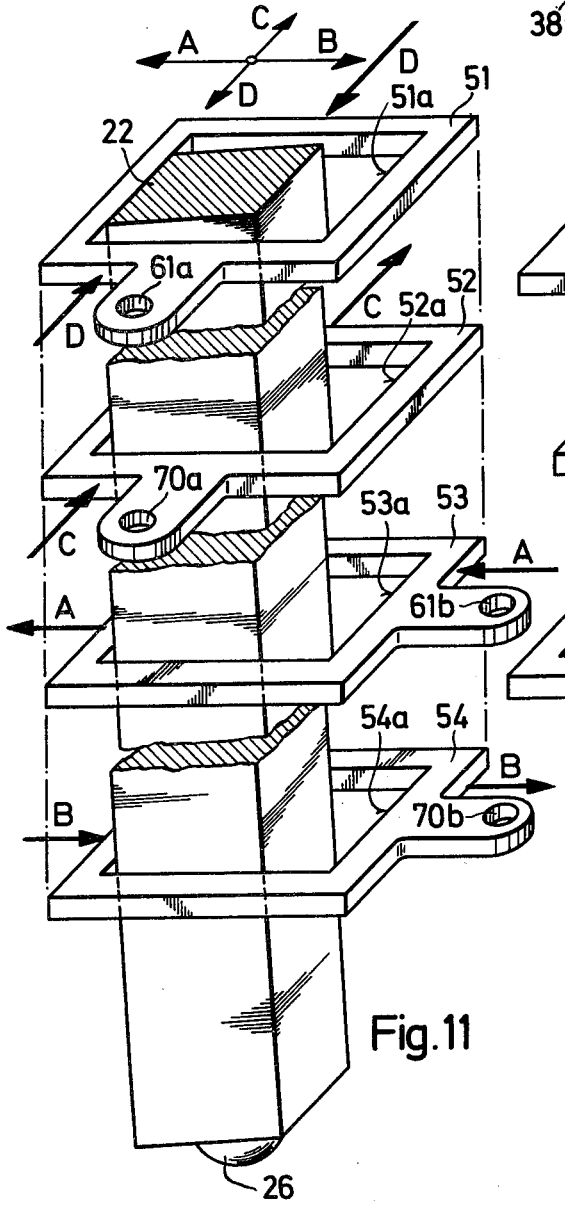
Fig. 11
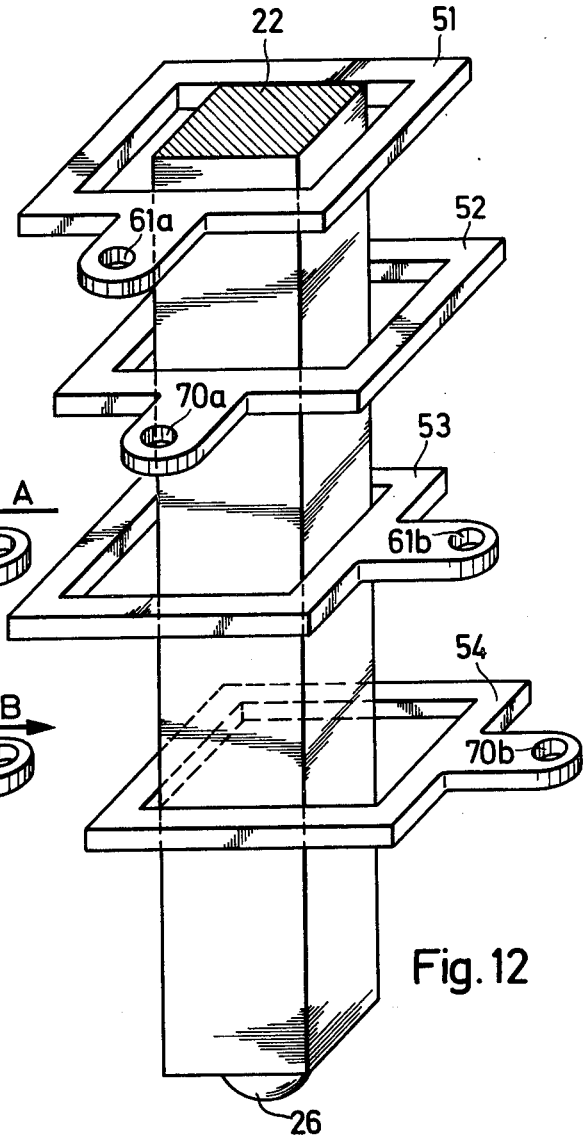
Fig. 12

121
122
144
147
137
125
132a
132
134
111
119
118
116
112
115
114
113
110
132
135
153
152
151
150
149
129
123
124
126
117
128
142
143
89a
89
165
146
148

KEYBOARD ACTUATABLE WITH THE AID OF THE FINGERS OF AT LEAST ONE HAND

RELATIONSHIP TO EARLIER APPLICATION

This patent application is a continuation-in-part of my pending patent application Ser. No. 729,075 filed Oct. 4, 1976 now U.S. Pat. No. 4,081,068.

This invention relates to a keyboard, actuatable with the aid of fingers of at least one hand, which keyboard comprises a support frame, at least one row of keys, each of which can be moved out of an initial unoperative position by the tips of the index finger, middle finger, ring finger and little finger, respectively, without or with a hand rest for the ball of the thumb or wrist of the said hand, on which rest this hand can be continuously supported in a rest position during actuation of the keyboard, the keys in one row constituting a guide key row in which the keys for each hand to be used for operating the keyboard are arranged on a curve, which corresponds to the natural disposition of the finger-tips when the finger are, without being tensioned, in a slightly curved and spread, but relaxed posture.

Keyboards of the above type are known from German Pat. No. 1,279,693 (corresponding British Pat. No. 1,016,993) to International Business Machines Corporation (IBM), IBM Technical Disclosure Bulletins on "Digital X" Typewriter Keyboard" by D.L. Conway (Vol. 18, No. 12, May 1976) and on "Input Keyboard" by P.E. Stuckert (Vol. 14, No. 3, August 1971) and from German Offenlegungsschrift No. 22 18 065 to Georg Nawroth published Oct. 31, 1973. German Pat. No. 1,106,342 to Kuno Graf von der Schulenburg published for opposition May 10, 1961 also describes a similarly arranged keyboard in which the keys can be depressed for contact and also tilted.

Similar keyboards are described in U.S. Pat. No. 2,532,228 issued Nov. 28, 1950 to Frank H. Hesh.

An actuating unit somewhat resembling the unit used as key at least in the guide key row of the keyboard according to this invention is shown in FIGS. 2, 7 and 8 of U.S. Pat. No. 3,633,724 issued on Jan. 11, 1972 to Ronald A. Samuel.

With the known keyboards of this kind, the hand, the fingers of which are to actuate the keyboard, is normally held poised above the keyboard, with constant strain on the muscles of the upper arm and, in particular, of the fore-arm, and the tips of the operating fingers should either not rest at all on the keys of a normal or guide row, or should only rest on them so lightly that the keys are not actuated. The keys of modern typewriters and similar machines, however, can be so finely set that even a very slight pressure suffices to actuate them. With these modern machines it is not possible to rest the fingertips truly on the keys, when not actuating them, but only so much that, in particular, the muscles of the fore-arm must still largely or completely provide the effort involved in keeping the wrist continuously raised.

Furthermore, operation by touch, particularly on typewriters, requires that the wrist of the hand, the fingers of which are actuating the keys, or the wrists of both hands be held in, or continuously moved back to, a position in which the actuating fingers are poised immediately above certain keys of a normal or guide row of the keyboard so as to enable either the key located below a finger-tip or a key positioned above, below or to the side of that key, to be struck from this initial position without the lettering on the keys having first been read. Therefore, with the known keyboards, the entire "writing" procedure by actuation of the keys involves considerable strain on all the muscles of the arm and corresponding mental concentration simply for the purpose of continuously bringing the fingers back to the initial position above the normal row of keys. This is fatiguing and often leads to irritation of the nervous system and discomfort to the wrist and fore-arm.

OBJECT AND SUMMARY OF THE INVENTION

A first object of the invention is therefore to provide a novel keyboard which enables the actuating fingers of one or both hands so to rest at random pressure on the keys in a normal or guide row, even when the keys are not actuated, that the above-mentioned strain on the wrist and fore-arm is considerably reduced or even completely avoided.

Another object of the invention is to provide an arrangement of novel keys which can be operated with full mental concentration solely on the decision which key to strike and on the initiation of the movement necessary to carry this decision into effect while freeing the typist or the like operating person completely from the mental concentration and corresponding muscle control necessary to carry such movement to completion and for the need thus to control the return movement of the actuating finger to its rest position on the corresponding key of the guide row.

A still further object of the invention is to provide a novel individual key unit or actuating unit for the abovementioned keyboard, with which unit the tip of the finger actuating the key can lie on the key at random pressure in the rest position so that a rest element can be provided, preferably, for the wrist as well.

A third object of the invention is to provide an actuating unit of the last-mentioned kind for an individual actuating finger, with which unit, not only one or two, but also a greater number of characters can be written or fed in and printed out.

A further object of the invention is to provide a keyboard, particularly for typewriters, which enables typing to be carried out more rapidly and without the risk of several keys being simultaneously struck.

A final object of the invention is to provide a keyboard on which the number of characters is considerably greater than in the corresponding known machines, particularly typewriters.

In a keyboard of the initially described kind, these objects are achieved, in accordance with the invention, by that the keyboard is characterized in that each key of said guide key row has a top face and comprises at the end thereof opposite said top face supporting means adapted for preventing downward depression of said key while permitting lateral shifting of said key toward at least one determined operational position, thereby permitting random vertical pressure to be exercised by a finger tip on said top face of a key of the guide key row without causing operational displacement of the latter key.

Preferably, each key of said guide key row further comprises biassing means adapted for offering initial resistance to lateral shifting movement of said key, but decreasing said resistance as soon as the lateral shifting movement of the key is in progress, thereby causing the shifting movement to continue automatically till the key has been fully shifted to an operating position.

Also, in a preferred embodiment of the keyboard or actuating unit according to the invention, each key of at least said guide key row further comprises guiding means for guiding said key in one or several predetermined lateral shifting directions while preventing lateral shifting of the key in directions intermediate said predetermined directions.

Each key of at least said guide row preferably further comprises a resetting device which is adapted for automatically returning the key from a fully shifted first operational position to the unoperational rest position and automatically preventing the returning key from passing through said unoperational position and being shifted in a direction toward an operational position, and, upon said key being arrested in the unoperational position, setting the key free for further shifting to an operational position.

The keyboard in accordance with the invention may also, in a known manner, include at least one key which can be actuated by the thumb of the hand whose fingers are operative, and which is arranged in a position relative to the curve that corresponds to the natural untensioned position of the thumb in the above-mentioned disposition of the finger-tips when the fingers are held in untensioned position.

Furthermore, the keyboard in accordance with the invention may include a second row of keys, which is disposed farther away from the hand rest than the said normal row of keys and is located at a somwhat higher level than the normal row, each of the keys of the second row being adjacent a key of the normal row and being arranged at such distance from the key of the normal row that, by slightly stretching the finger concerned, it can be reached by the tip of this finger, thus actuating the corresponding key of the second row, while the wrist is still supported on the rest.

An auxiliary key, which is disposed between the rest for the wrist and the corresponding key of the normal row, can be associated with at least one of the keys of the normal row.

In this arrangement, preferably at least one key of the normal row can be swung from its rest position in a plurality of directions by the finger-tip resting thereon, for actuaing the key concerned.

Thus, the swingable key in the normal row can be swung from its rest position in any of four directions at right-angles to each other.

Also, at least one key of the second row can be tilted in a plurality of directions by being touched by the tip of the finger when slightly stretched from its rest position on that key of the normal row that is associated with the said second-row key.

The tiltably key in the second row can be tilted preferably in any of three directions, and one of the tilting movements of this key can be executed by further stretching the finger concerned, and the other two by moving the finger sideways to the right or left.

The above-mentioned auxiliary key can be disposed below, but not in contact with, the middle joint of the finger concerned, which, in its rest position, lies with its tip on the corresponding key in the normal row, and said auxiliary key can be actuated by stretching the finger, thereby lifting its tip from its key in the normal row, and by lowering or laterally tilting the middle joint of the finger.

The hand rest can be arranged to be swung in a support frame towards one side or towards opposite sides of the hand.

Preferably two rests are provided, one for the right hand and the other for the left hand of the operator, and the curve on which the keys of the normal row for the fingers of the left hand are arranged can be disposed to form a mirror-image arrangement with the curve along which the keys of the normal row for the fingers of the right hand are arranged.

The second and third of the above-mentioned objects are achieved by means of a novel actuating unit for a keyboard in accordance with the invention, which unit comprises a supporting frame, a key having a top face destined for having the tip of a finger rest thereon, a key rod on the underside thereof, a non-depressable mounting whereby said key rod is mounted in said supporting frame and is disposed in a rest position at right angles to a bearing plane of said supporting frame, at least one contact switch having a stationary and a movable contactor, the key rod bearing said movable contactor near the tiltable key-bearing end thereof, an electrical operating circuit into which said switch is inserted, the switch being opened in a rest position of the key without making contact, thereby interrupting the flow of current through said operating circuit, and being closable by movement of the key away from its rest position, thereby making contact and thereby closing the operating circuit, and the movable contact being so disposed on the key rod as to make electrical contact when said key and key rod are tilted out of their rest position by means of movement of the finger-tip, wherein the mounting is adapted for supporting random vertical pressure thereon by said finger-tip and preventing the key rod from making electrical contact in the rest position.

Preferably, the mounting means for mounting the key in the frame comprises a ball joint for mounting said key rod in said supporting frame and an element for preventing the key rod from turning about its axis; or a knuckle joint, said ball joint or knuckle joint being mounted on that end of said key rod remote from said key.

A plurality of the contact switches mentioned above can be provided about the key rod, and a guide device which permits the key and key rod to be tilted only towards one of the stationary contactors of the contact switches, which guide device comprises a screen which surrounds the key rod and has cut-away portions, with each of which is associated one of the directions of tilting of the key from its rest position, so that the key can be moved into only one of these cut-away portions each time for the purpose of making contact with a contact switch associated with the cut-away portion concerned.

Furthermore, a return device for moving the key from an actuating direction into the rest position can be provided, the return movement of which device is positively initiated immediately upon completion of contact-making by the key, even when the finger-tip continues to exert actuating pressure, and the return device can include means for limiting movement whereby the positively returned key is retained in its rest position.

In this arrangement, the return element can include at least one pair of frames which are fitted opposite each other and surround the key rod, and drive means for moving the two frames on to each other, which drive means are caused to operate by the completion of contact-making, and, when the key rod reaches its rest position, the frames bear simultaneously with those of their inner edges facing the key rod on both sides of the latter, thus arresting its return movement.

One of the two frames of the said pair can be moved in a direction opposite that in which the key has been moved for making contact, and the other can be simultaneously moved in the last-mentioned direction by the drive means.

At least one pair of oppositely disposed contact switches, between which the key rod is centrally arranged, and two pairs of frames can be provided, one pair of which frames is associated with the two contact switches and is displaceable along the line of movement passing through the two contact switches, whereas the second pair are displaceable at an angle to said line of movement.

Also, two of the said pairs of contact switches can be provided, and a pair of frames can be associated with each of these pairs, the lines of contact which extend through the two pairs of contact switches forming a right-angle with each other.

The drive means for moving the two frames of each pair of frames towards each other can comprise at least one first electro-magnetic device which is energized in a secondary circuit of the operating circuit by the flow of current resulting from closing of the contact switch, as well as an electrical switch device whereby energization of the electro-magnetic device is maintained, even after the contact switch has opened, until the key is fully returned, and finally a second electro-magnetic device which is energized when return of the key is completed and which causes the frames of said pair of frames to move away from each other into their initial positions.

Each contact switch present can include a stator element mounted in the support frame, and of the stator element and key, one of these is electrically insulated from earth and is connected to the operating circuit, and the other is earthed, so that, when the key is moved from its rest position towards the stator element, contact is made.

The key can incorporate a control element which offers, to the finger-pressure, an initial resistance which can be overcome by said pressure, but which, after having been overcome, immediately decreases rapidly when the swinging movement begins, so that once the movement has been initiated it continues in a positive manner until the contact is closed.

Furthermore, each contact switch present can include a stator element mounted in the support frame and a tongue member mounted on the key rod or on the support frame, and of the stator element and tongue member, one of these is electrically insulated from earth and is connected to the operating circuit, and the other is earthed.

Finally, the key rod can be designed as a permanent magnet, one pole of which is connected to the key and the other pole to the mounting of the key rod in the supporting frame, so that the tongue member is swingably mounted in the zone of the last-mentioned pole on the key rod and has its own magnetism which is of opposite pole to the magnetism of the key rod, so that the free end of the tongue, in the rest position, forms a magnetic circuit with the pole of the key rod that is connected to the key, a stop element being provided which limits the movement of the free end of the tongue towards the pole of the key rod that is connected to the key, so that when the key is moved out of its rest position away from the tongue member, the latter cannot follow this movement, whereby the said magnetic circuit is broken and the magnetic force of attraction between the free end of the tongue and the pole on the key rod that is adjacent the key decreases rapidly.

BRIEF DESCRIPTION OF THE DRAWINGS

Details of the invention will now be described by reference to a preferred embodiment which is illustrated in the annexed drawings, wherein:

FIG. 1*a* shows an oblique perspective view of this typewriter from the front, and FIG. 1*b* shows a sideview having a partially cut-away portion on the left side of the typewriter;

FIG. 3 shows this actuating unit in its rest position, and

FIG. 4 shows the unit in its actuated position;

FIG. 8 is a perspective view of part of the actuating device shown in FIG. 3;

FIG. 9 is a cross-section through the FIG. 3 actuating device along a plane indicated by the numerals IX—IX in that Figure;

FIG. 10 is a perspective view of a form of the actuating unit for the middle joint and FIG. 10A is a perspective view of part of the same unit seen from the opposite end;

FIGS. 11 and 12 illustrate diagrammatically a form of the return device in accordance with the invention which comprises four catch-plates and which is associated with a single actuating unit as illustrated in FIGS. 3 and 4, and of these Figures:

FIG. 11 illustrates the position of the four catchplates when the unit is actuated and at the moment of commencement of the return action, and FIG. 12 shows the four catch-plates at the moment of completion of the return action and before the four plates have returned to their initial position as shown in FIG. 8, the actuating unit being returned to its rest position;

DETAILED DESCRIPTION OF THE EMBODIMENTS

Figure 1A:
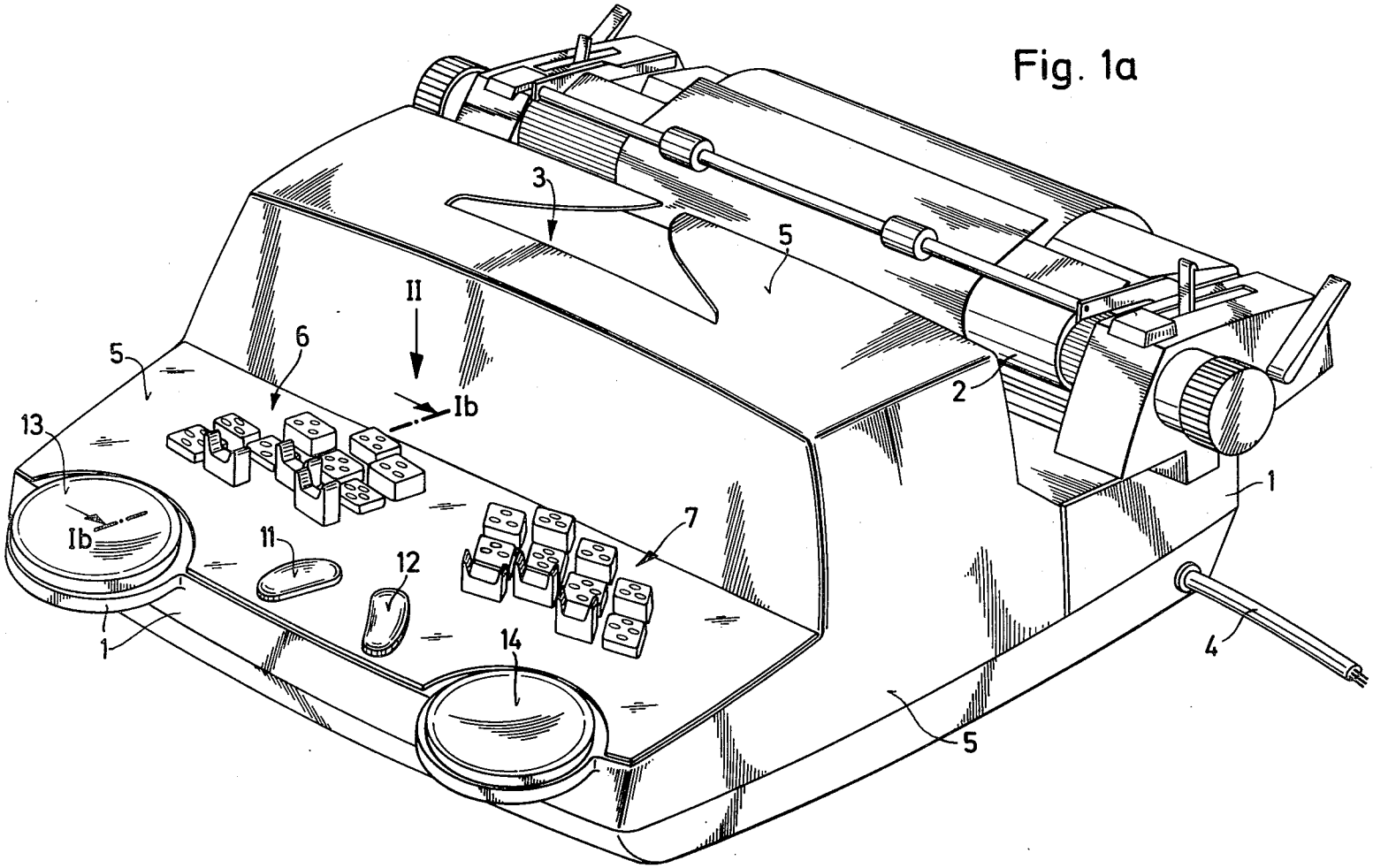
FIGS. 1*a* and 1*b* show the arrangement of a preferred form of the keyboard of the invention in an electric typewriter having a housing specially designed to accommodate this keyboard, and of these Figures.
Figure 1B:
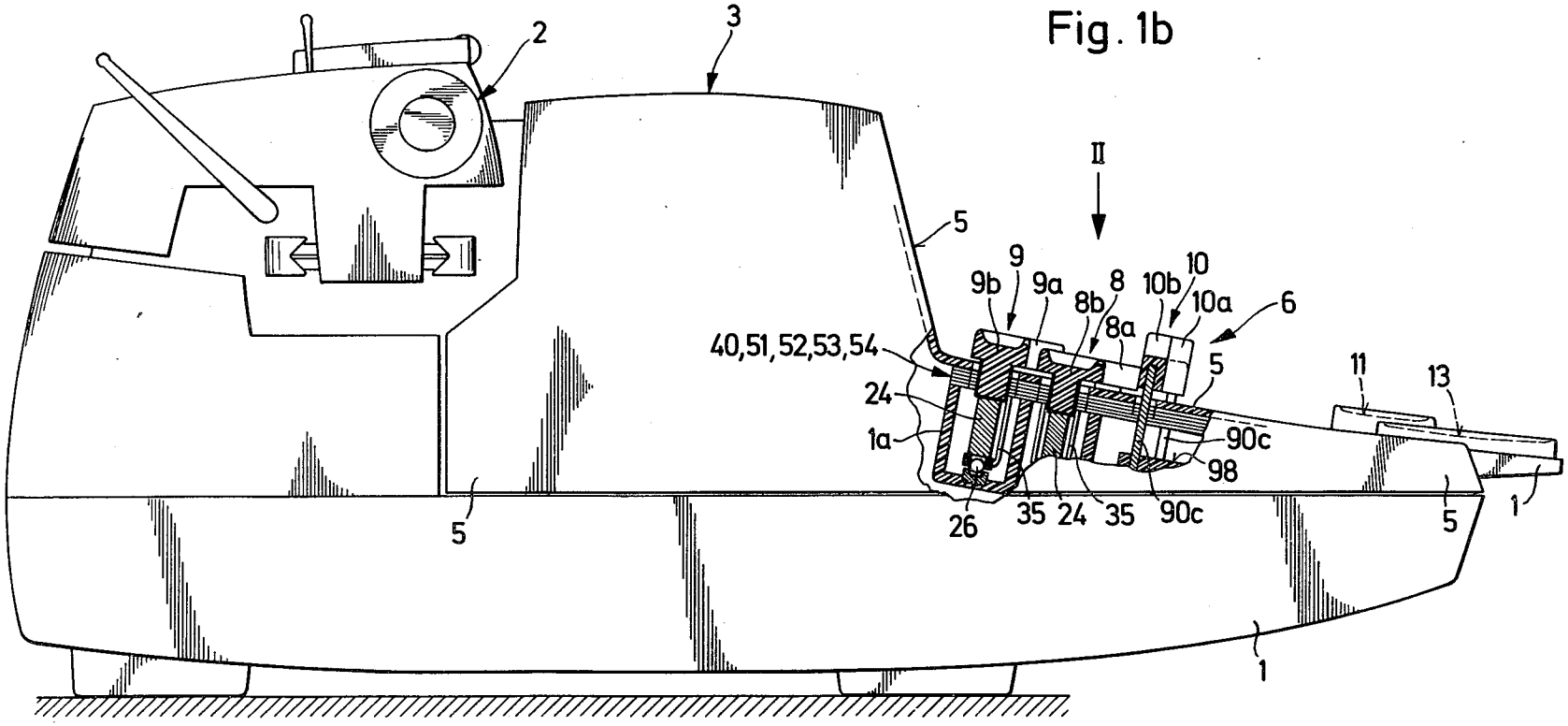

The electric typewriter illustrated in FIGS. 1*a* and 1*b* includes a housing 1, a normal roller 2 with carriage-shifting means (not shown), a set of type-blocks 3 and a cable 4 with a plug for connecting to the local electric supply mains. Built into the front side 5 of the housing 1 is a keyboard in accordance with the invention which comprises a left-hand group of keys 6 and a right-hand group of keys 7, each of the two groups consisting of: a plurality of actuating units each of which includes a key of a first type 8, a second type 9 and a third type 10; a left and right thumb key 11 and 12 respectively; and a left and right support 13 and 14 respectively for the wrists and/or thumb-balls.

The following symbols for indicating movement are used in the drawings:

↔ movements in the plane of the paper,

⊙ movements at right-angles out of the plane of the paper and

⊗ perpendicular movements into the plane of the paper.

Figure 2:
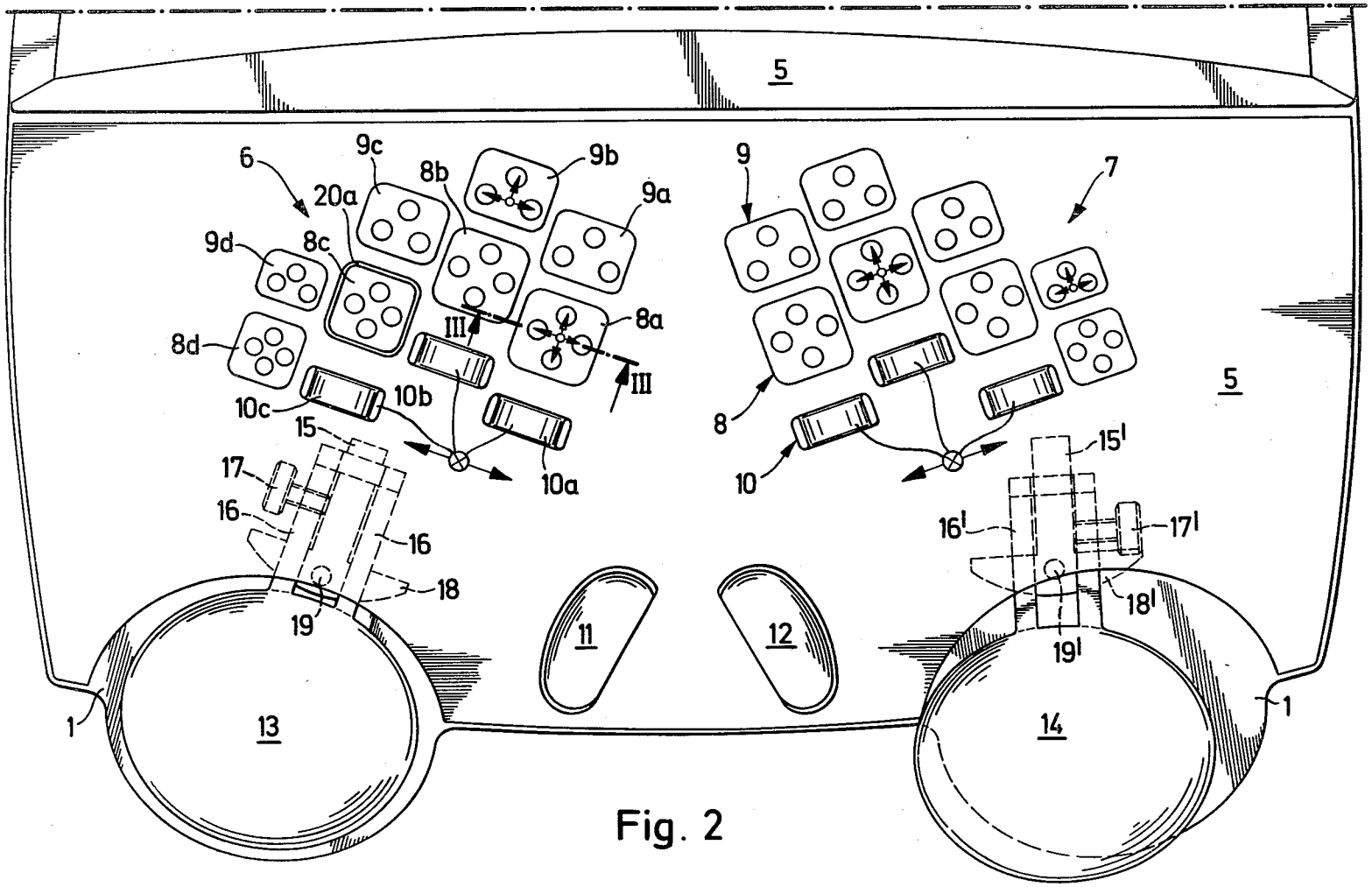
FIG. 2 illustrates diagrammatically and in plan view a preferred form of this keyboard.

As shown in FIG. 2, each group of keys comprises: actuating units 8 of the first type provided with keys, with each of which units four different type levers can be moved and on which units the finger-tips can rest in the initial position; actuating units 9 of the second type whereby three different type levers can be actuated; actuating units 10 of the third type, each of which, in the initial position, is located below the middle joint of a finger and each of which can actuate three type levers; and the previously mentioned thumb key 11 or 12 and the associated hand rest 13 or 14.

FIG. 2 also illustrates diagrammatically a device for positioning the hand rests 13 and 14 which device consists of rails 16 and 16' mounted in the machine housing 1 and displaceable along guide bars 15, 15', and of locking screws 17 and 17' whereby the distance of the hand rests 13 and 14 from the left-hand and right-hand group of keys 6 and 7 respectively can be adjusted to suit the size of the hands of the typist. Limited swing to the right or left can be achieved by means of segmental elements 18, 18' which also form part of the positioning device, are likewise provided with locking screws 19, 19', and support the guide bars 15, 15' along which the rails 16 and 16' are moved.

An individual actuating unit of the first or second type will now be described by reference to FIGS. 3 to 5.

Figure 3:
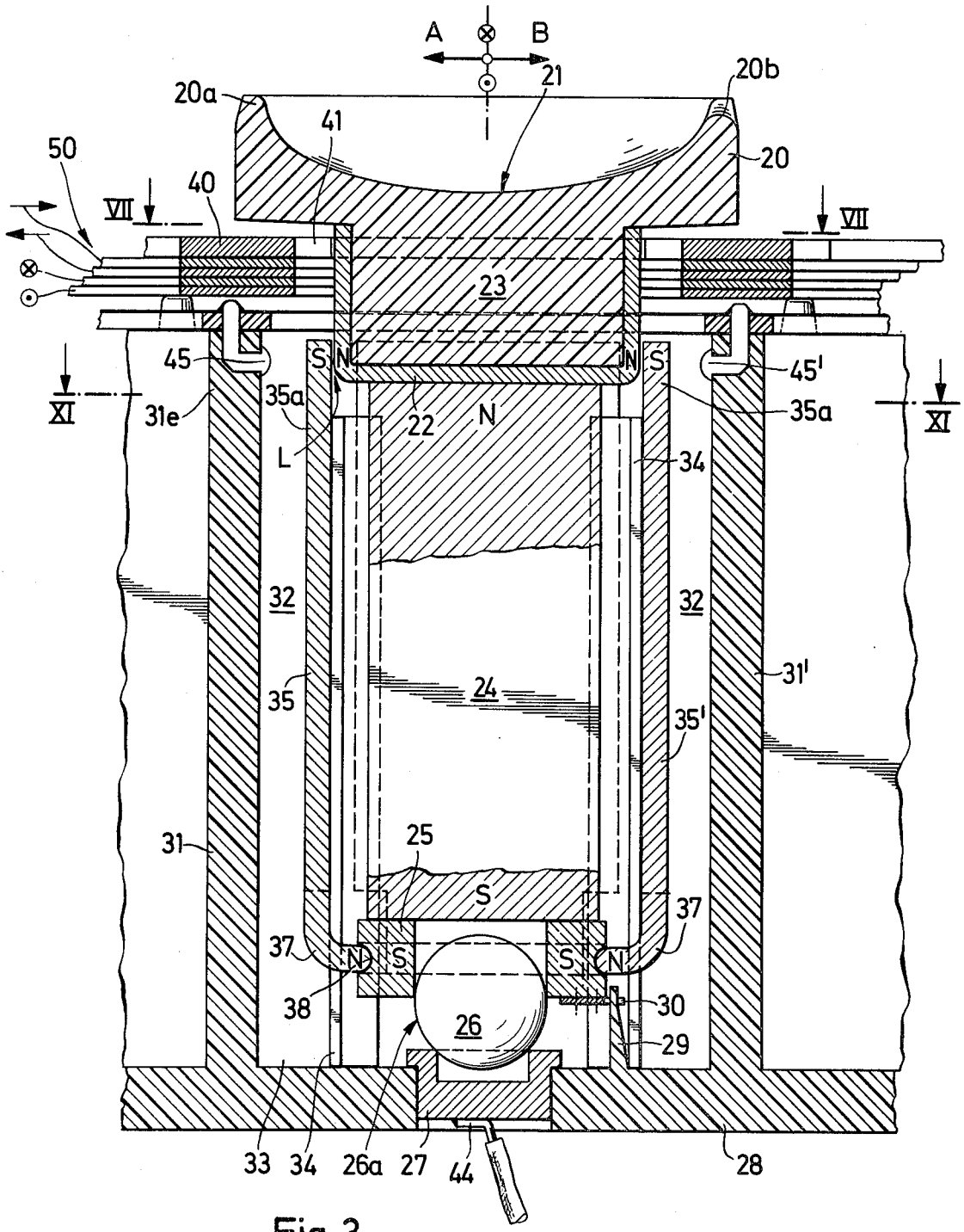
FIGS. 3 and 4 are sectional views along the axis of an actuating unit in accordance with the invention and for the keyboard shown in FIG. 2, and of these Figures.
Figure 4:
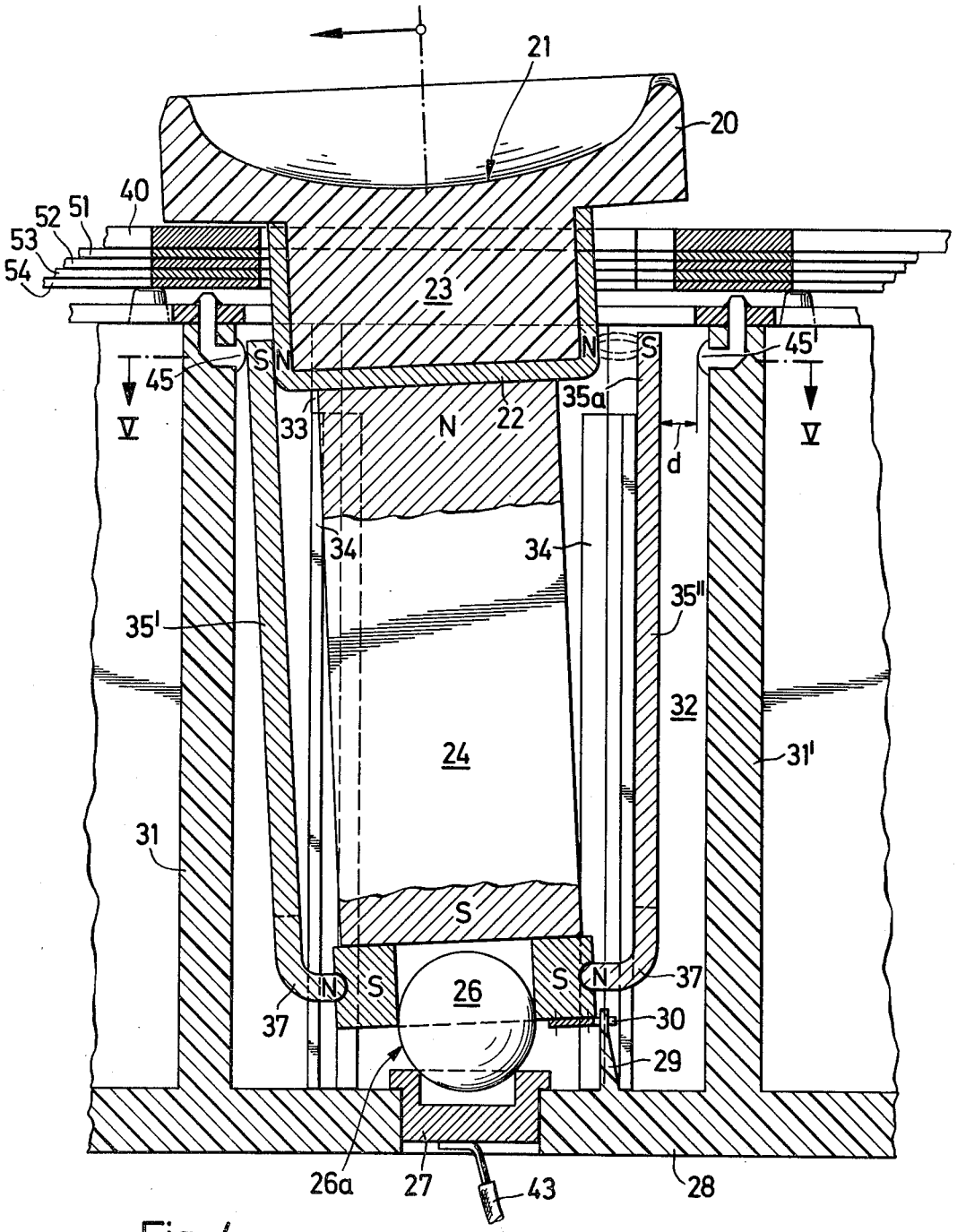

FIGS. 3 and 4 illustrate in detail the construction of such an actuating unit.

During typing, the finger, when not being used, rests on the central face 21 of the key 20. The surface of the key 20 is hollowed in such a way that the finger-tip is able to rest comfortably in the key. For this purpose, the surface is surrounded by a rim 20*a* which provides the finger with the necessary support and which, in this embodiment, forms a square or rectangle with rounded corners (FIG. 2). The zone 20*b* of the rim on that side facing the wrist can be so formed that the portion of the finger below the tip is able to rest comfortably thereon. In FIG. 3 however it is shown as being so formed that the top finger joint can extend slightly obliquely downwards into the hollow portion of the key and the finger-tip can rest comfortably on the floor of the hollow.

Secured to the underside of the key 20 is a magnetic pole shoe 22 of soft iron which is somewhat smaller than the body of the key and is firmly fitted on the base 23 which projects from the body of the key. The key rod 24, which is made of sintered, highly permanently magnetic material and is of square cross-section, is firmly connected to the lower face of the base 23. The key rod may also be made of high-magnetic steel or it may consist of an electric magnet; furthermore this rod may be circular. At its lower end the key rod 24 carries a pole shoe 25 which is firmly connected to it. Firmly fitted in the annular pole shoe 25 is a ball 26, the lower portion of which (e.g. a half or a larger portion of the ball) projects in the downward direction. The projecting part 26*a* of the ball rests in a seat 27 of ordinary iron and can swivel in all directions therein, this iron exerting only a slight attractive force on the highly magnetic key rod 24 so as to retain it in seat 27.

Instead of the ball joint (25,26,27), use can also be made of an ordinary knuckle or universal joint for non-rotatably mounting the lower end of the key rod on the carrier frame 28. The carrier frame 28 is in turn secured to the housing 1. In the present arrangement, the key rod 24 is prevented from rotating about its longitudinal axis in that a pin 29 for preventing rotation projects from the carrier frame 28 and extends between the two arms of a bifurcated retaining member 30 secured to the pole shoe 25. The clearance between the arms of the bifurcated member 30 and the pin 29 suffices to permit the key 20 to swing slightly (e.g. through 10° to 20°) in the direction indicated by the arrows A and B. The slot in the bifurcated member 30 may also be so wide that the key can swing through a corresponding distance at right-angles to the plane designated by the arrows A and B.

This can also be achieved by fitting the bifurcated retaining member 30 and the pin 29 for preventing rotation at an angle of 45° to the side-walls of the key rod 24. Mounted on the carrier frame 28 opposite at least one side of the key rod 24 is a support element 31, and preferably such an element 31*a*,31*b*,31*c* and 31*d* (FIGS. 8 and 9) is fitted at each longitudinal face of the square-section column formed by the key rod 24. Near the upper end of the key rod 24, corner guide ledges or ridges 33 project into the gap 32 in the inner corners of each two adjacent support elements 31, which beads project into the vicinity of the edges formed by each two sidewalls of the key rod 24. The support elements 31 as well as the carrier frame 28 and the guide ledges 33 can be made of thermoplastics material and preferably in one piece. Instead of a plastics material, use may also be made of some other magnetically neutral, non-ferromagnetic material, e.g. brass, aluminium, pressure-cast tin and the like. On their ends facing the key rod 24, the guide ledges 33 have shallow guide ribs 34 which extend parallel to the side-walls of the square key rod 24.

A magnetized rocker plate 35 is loosely guided by each two guide ribs 34*a* and 34*b* located on one and the same side of the key rod 24. At its lower end the rocker plate 35 is angled towards the key rod 24, and the angled arm part 37 is mounted by its free end 37*a* in a circumferential annular channel 38 in the outer cylindrical wall 39 of the annular pole shoe 25. In this arrangement, the free end 37*a* preferably has a rounded or pointed end edge which is mounted over an arcuate (concave) area in the surface whereby it is in contact with the annular channel 38 which is of semicircular cross-section. The rocker plate 35 is held in the channel 38 by the force of attraction between the opposite poles of the annular pole shoe 25 and the angled arm part 37. At its upper end there is attraction between the opposite magnetic poles of the pole shoe 22 and the upper end 35*a* of the rocker plate. Thus the rocker plate 35 moves into engagement with the inner face of the guide ribs 34. For manufacturing reasons and for the purpose of preventing excessive slowing down on account of friction on the sides of the end portion of the rocker plate, a small air-gap L is present between the upper end 35*a* of the rocker plate and the pole shoe 22 when the key rod 24 is in its central rest position as illustrated in FIG. 3.

To ensure that the key rod 24 actually does swing in the plane indicated by the arrows A and B (FIG. 3) and does not move obliquely out of this plane, a guide screen 40 is secured to the upper end 31*e* of the support element 31, which screen has cut-away portions 41 on each side in which the key rod 24 swings, the pole shoe 22 moving into the cutaway portions with slight clearance when swinging occurs in the direction indicated by the arrow A, e.g. in the case of the FIG. 3 arrangement.

The actuating unit serves for example as a contact switch for closing a main or operating circuit 43 (FIG. 6), which switch is on the one hand continuously connected via the contact member 44 to the seat 27 forming a pole shoe and through this to earth, whereas on the other hand, the current is further conducted through the contact pole 45 fitted on the inside of the upper end 31*e* of the support element 31. Connected into the circuit are one or two operating electromagnets 89, 99, through which an operating part 83, e.g. the type-lever unit of an electric typewriter (FIG. 15) is operated.

Figure 5:
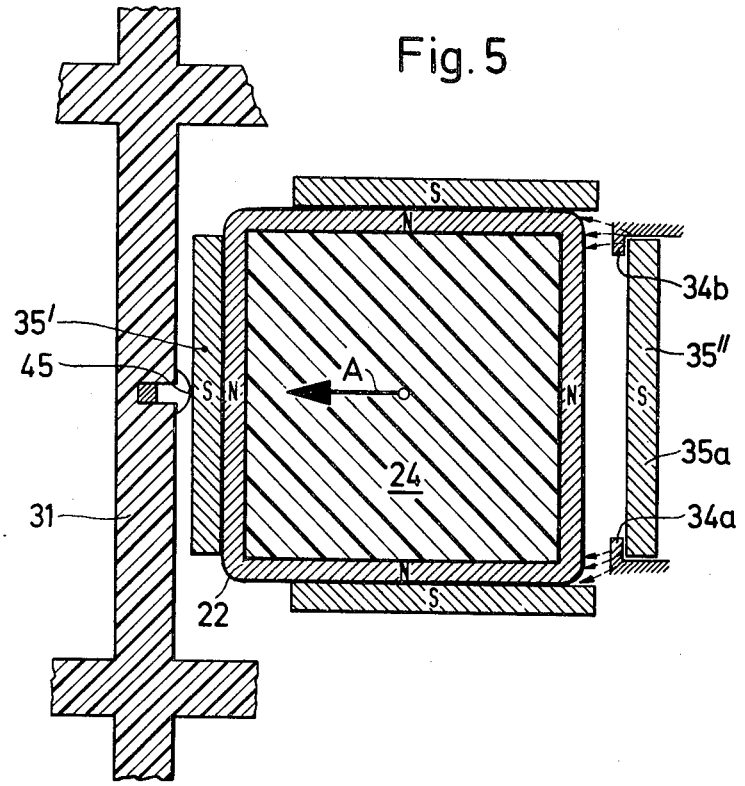
FIG. 5 is a cross-section through the actuating unit of FIG. 4 along a plane indicated by the numerals V—V in the latter Figure.

The circuit 43 is closed by swinging the pole shoe 22 in the direction indicated by the arrow A, by using the fingertip, resting lightly on the key 20, to apply lateral pressure on one of the sides of the upstanding rim 20*a* of the key, and in this way the rocker plate 35 is pushed away from the position in which it lies against the associated guide rib 34, likewise in the direction indicated by the arrow A, until the outer side of the upper end 35*a* of the rocker plate, that is the side facing away from the pole shoe 22, is pressed against the contact pole 45 (FIGS. 4 and 5).

Normally, a second rocker plate 35″ is fitted on that side of the key rod 24 that is remote from the swung rocker plate 35′, which second rocker plate co-operates with a contact pole 45′ on the inside of the support element 31′, and the distance d between the rocker plates 35′ and 35″ on the one hand and the contact poles 45 and 45′ respectively associated therewith is in the order of one millimeter in the rest position.

If the finger-tip now applies pressure on one of the lateral zones of the rim 20*a* of the key in the direction indicated by the arrow A, it must first overcome the attraction between the opposite poles of the pole shoe 22 and the rocker plate 35″ (magnetic flux lines shown in FIG. 5). This attraction however decreases with the square of the distance between the two magnet poles, i.e. very rapidly. In this connection, because of the physiological limits set on controlling the movement of the finger-tip and as existing in the operator, it is practically impossible for the movement of the pole shoe 22 in the direction indicated by the arrow A, once initiated, to be slowed down again by the operating finger before the contact between the contact plate 35′ and the contact pole 45 (FIG. 4) has been established, particularly as the initially considerable resistance to this movement decreases rapidly and so suddenly with decreasing attraction between the pole of the pole shoe 22 and the rocker plate 35″.

If the actuating unit illustrated in detail in FIGS. 3, 4, 8 and 9 is provided with four rocker plates 35, mounted in the lower pole shoe 25, it is suitable for tilting in four directions and therefore for typing four symbols.

If however it is provided with only three rocker plates 35, then three symbols can be typed with it. Such an actuating unit is that designated for example by the numeral 9 or 9*a* in the keyboard arrangement shown in FIGS. 1*b*, 2 and 14.

Figure 14:
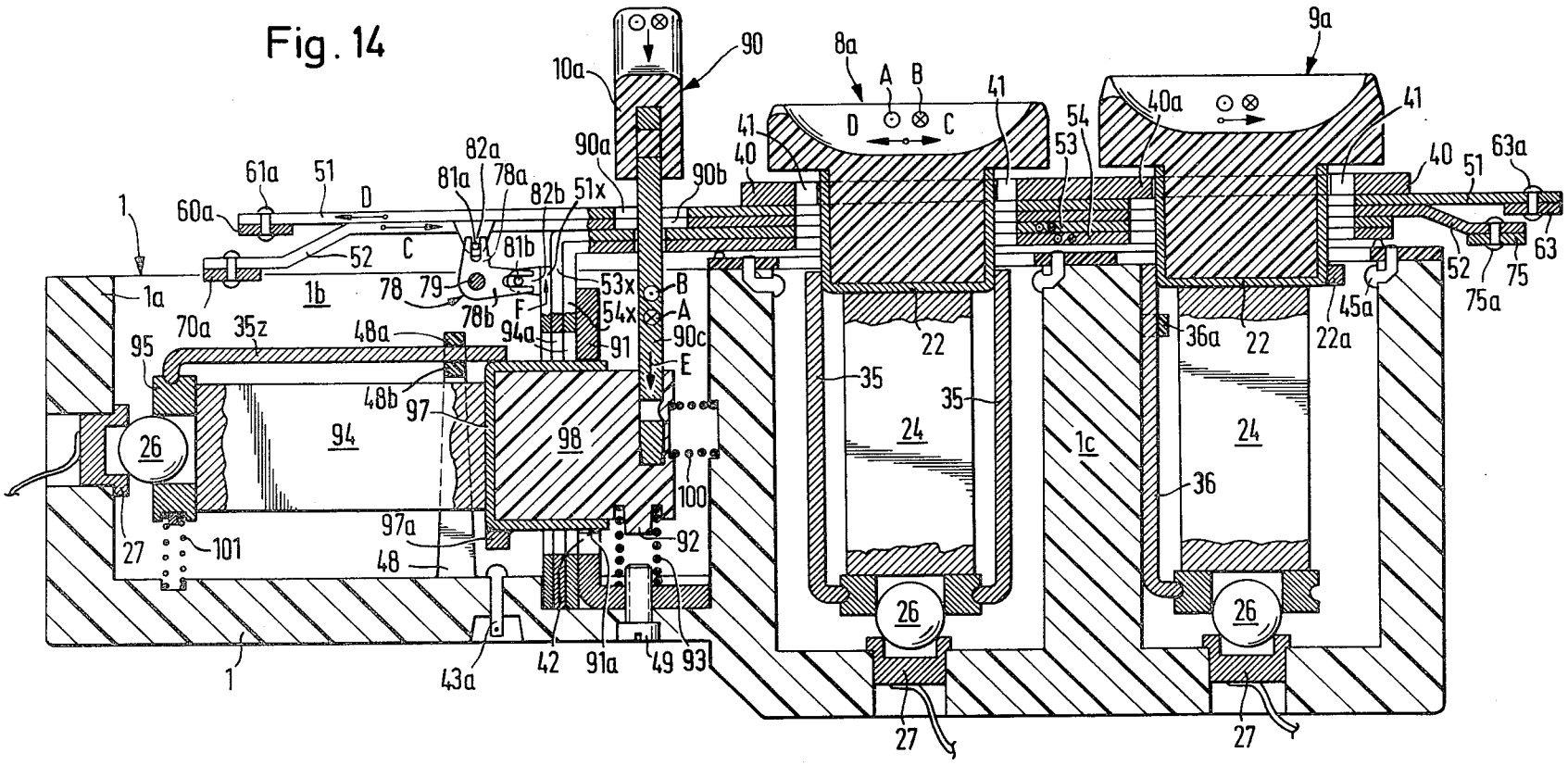
FIG. 14 shows a cross-section through the return device on the plane designated by the numerals XIV—XIV in FIG. 13.

In the case of the actuating unit 9*a* shown in the lastmentioned Figure, three rocker plates are provided in the lower pole shoe 25, and of these only the front plate, i.e. that nearest the operator, is shown, whereas the two other rocker plates, which are designed and actuated precisely in the same way as shown in FIGS. 3 and 4, cannot be seen in FIG. 14.

The illustrated rocker plate 36 differs from the two others in that it always bears against the frame part 1*c* and is secured thereto, slightly below the upper end of the rocker plate, by a clip member 36*a*, open at the side. This plate 36, made of ferromagnetic material, thus offers magnetic resistance when the key 9*a* is tilted away from the plate 36 towards the "rear", and this resistance has to be overcome.

On the side opposite the key rod 24, the key 9*a* has attached thereto only one contact pole 22*a* instead of a rocker plate on the upper pole shoe 22, and this contact pole 22*a* bears against the associated contact pole 45*a* and so closes the circuit 43 when the key 9*a* is tilted to the rear.

Active retraction of the key by the finger to return the key to its rest position is not desirable for the following reasons:

1. A second conscious action is required and this would fatigue the typist.

2. It might be possible that, with rapid retraction, the middle position is passed through and therefore the opposite contact is closed unintentionally.

3. Change-over to a consciously executed retraction movement in any case requires more time than is possible with mechanical automatic apparatus, i.e. the two "intentional" actions cannot follow each other so rapidly.

Figure 10:
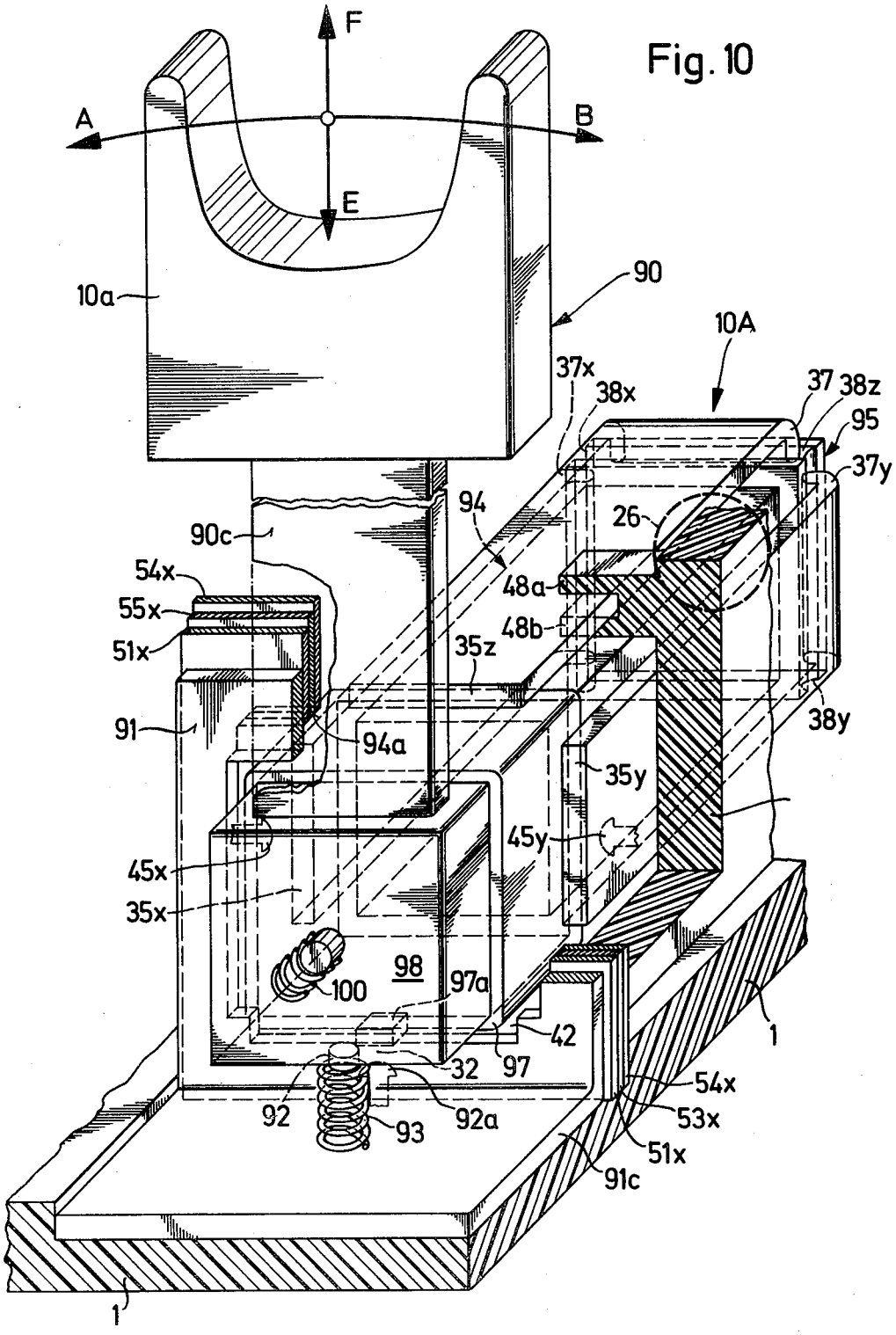

The key 90, illustrated in FIGS. 10 and 10A, represents the above-mentioned third type of key and it can be actuated without difficulty in one of the two directions A and B by tilting and in the direction E by being depressed, preferably with the middle joint of the forefinger, middle finger or ring finger (see keys 10, 10*a*, 10*b*, 10*c* in FIG. 2).

The actuating unit for the key 90 is to a large extent of similar design to that shown in FIGS. 3 and 4. Each middle joint key 90 has a key rod 94 which is surrounded by three magnetic rocker plates 35*x*, 35*y* and 35*z*, which serve to set up a magnetic resistance to separation, and of which, the plates 35*x* or 35*y* or the contact pole 97*a* close the circuit 43 when applied to the contact poles 45*x*, 45*y* and 92*a* respectively. The pole shoe 95 which carries the ball 26 and is secured to that end of the key rod 94 that is remote from the key 90, is here of square cross-section so as to achieve better magnetic contact.

Formed in the right, left and bottom side-wall of the pole shoe 95 are channels or grooves 38*x*,38*y* and 38*z* which extend transversely to the axis of the key rod and in which the angled arm parts 37*x*,37*y* and 37*z* are held by magnetic attraction. In order to hold the key 90 in a rest position in which the key rod 94 does not establish contact between the contact pole 97*a* and the contact pole 92*a* associated therewith and positioned below it in the supporting housing 1, but that, instead, the head of the key be held poised above this contact pole 92*a* while maintaining an air-gap 32, therebetween, the key 90 is mounted at its lower end in a thrust-tilting joint by means of a link rod 92 which is surrounded by a compression spring 93 which bears against the housing 1.

The automatic return device 50 shown in FIGS. 11 to 14 and provided for the purpose of automatically returning the keys 20 and 90 and therefore the entire actuating unit into its unactuated middle position, comprises four superposed frames or catch plates 51,52,53 and 54 which are guided above the supporting elements 31*a*–31*d* (FIGS. 8 and 9). In FIGS. 11 and 12, these frames are shown as being of square shape and spaced from each other rather than bearing closely against each other, and will be described in connection with a single actuating unit.

Each frame in fact serves as a return or catch plate for all the keys of the first and second type and some of the third type in a group of keys, as will be explained in detail by reference to FIGS. 11 to 14.

Referring to the simplified illustration in FIGS. 11 and 12, each of the four frames 51,52,53 and 54 has a window 51*a*,52*a*,53*a* and 54*a* respectively which is just large enough to accommodate the pole shoe 22 without its striking the four frames, when said pole shoe is in its outermost position upon being swung in the direction of the arrow A and also when it is in its outermost position upon being swung in the direction of the arrow B, as well as when swung into its two outermost positions in the directions of the arrows C and D, i.e. in the plane at right-angles to that designated by the directions of the arrows A and B. In the rest position the pole shoe 22 is centrally positioned in all four of the windows 51*a*,52*a*,53*a* and 54*a* at a uniform distance from all sides of the frames. In the above-described lateral tilting of the key 20 and of the pole shoe 22 connected thereto, in the direction of the arrow A, there occurs, because of the closing of the contact between the upper end 35*a* of the rocker plate and the contact pole 45 and of the resulting closing of the current circuit 43 caused thereby, a current pulse through the secondary circuit 59 in which is contained the electro-magnets 68, the iron armature 68*a* of which actuates a return lever 60 (FIG. 13), whereby the frames 51,52,53 and 54 are moved in the direction of the arrows A,B,C and D respectively, indicated on each frame in FIG. 11, and are transferred to the positions shown in FIG. 12. While, in the position shown in FIG. 11 and with the key 20 tilted as in FIG. 4, the frames 52,53 and 54 are not in contact with the pole shoe 22 through their window-edges that trail during displacement, the frame 54 in particular bears through this window edge on the pole shoe 22, an air-gap of a fraction of a millimeter in width possibly being present. If the frame 54 is now displaced in the direction of the arrow B (by means of the lever 60, see FIG. 13), it carries with it the pole shoe and therefore the entire actuating unit containing the pole shoe and moves them into the rest position (FIG. 12).

The pole shoe 22 on the key 20 also bears on the frames 51,52 and 53, but during the return motion these only slide on the pole shoes 22 so as to guide its return swing into the middle rest position.

However, a slight gap of a fraction of a millimeter remains between all the inwardly displaced frames and the pole shoe 22 when the actuating unit is accurately brought back into the rest position. The frames 52,53 and 54, disposed below the top frame 51, can have slightly smaller windows 52*a*,53*a* and 54*a* so as to compensate the increased gap when the key 20 is tilted.

In its tilted position (FIGS. 4 and 11) the pole shoe 22 should, ideally, just bear against that edge of the frame 52 nearest to it. In practice it is preferred to provide a minimum air-gap. With a larger gap, the frame 54 would strike the actuating unit in an undesirably violent manner upon actuation of the frame.

The frames 51,52 and 53, which are displaced simultaneously in the directions indicated by the arrows A,C and D respectively, all simultaneously abut the sides of the pole shoe 22 presented to them, as the pole shoe arrives in the rest position, and they thus center it in the middle rest position, thereby preventing the pole shoe 22, and thereby the entire actuating unit, from being tilted to far and passing through and beyond the rest position, in the direction indicated by the arrow B.

Figure 13:
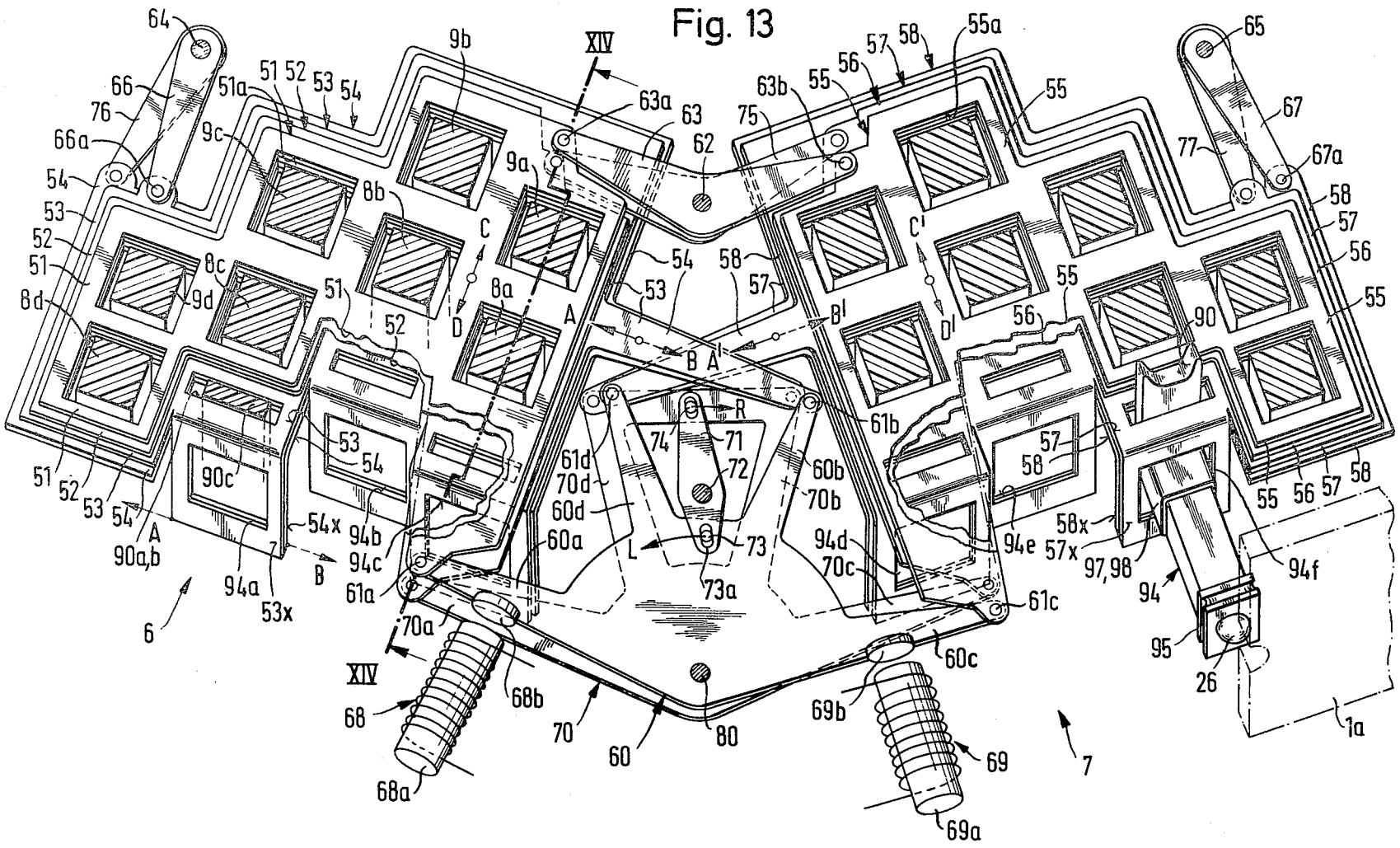
FIG. 13 is a plan view of the return device for the keyboard shown in FIG. 2, which device comprises two sets of catch-plates, the foreground part being shown in perspective.

In the arrangement shown in FIGS. 13 and 14, the frames 51 to 54 are designed as catch plates which, before the return movement is executed, are each superposed with the corresponding windows of the four frames registering with one another, to form two catch plate sets.

Figure 15:
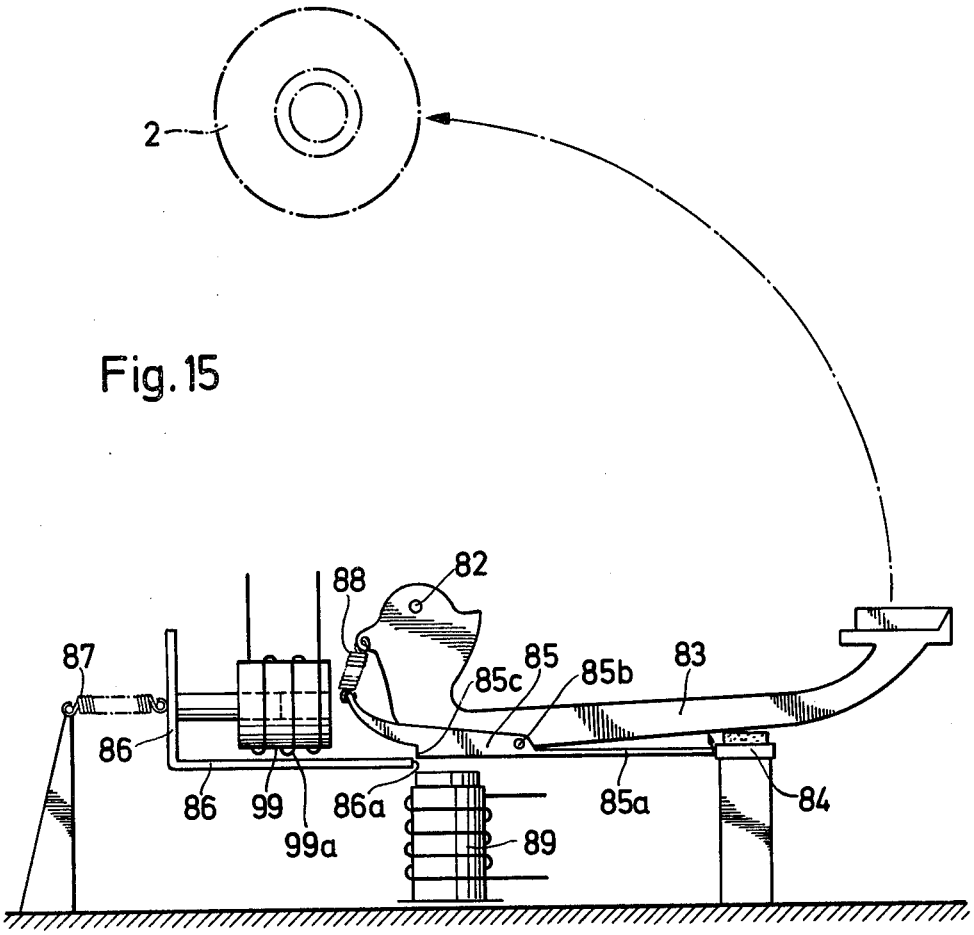
FIGS. 15 and 16 illustrate a known electro-magnetic actuating device for a form of typewriter, the two electromagnets of which are connected into the control circuit illustrated in FIG. 6, this actuating device having been described in Swiss Patent Specification No. 425 839 in the name of George Manus, and FIGS. 17 to 20 constitute a diagrammatic illustration of the form of electric typewriter marketed by Royal McBee Corporation, Port Chester, N.Y., USA, and as described by them in their Swiss Pat. No. 353 021, and of these Figures.
Figure 16:
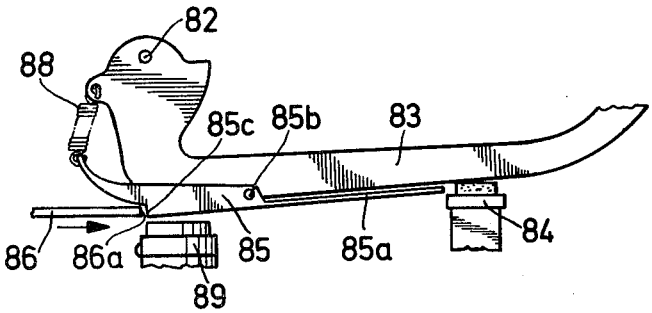

While current from the D.C. source 47 flowing in the main operating circuit 43 energizes the operating electromagnet 89 as a result of the above-described closing of the contact between the pole 45 and the upper end 35*a* of the rocker plate 35, and the current actuates for example the type lever 111 of a typewriter (FIGS. 17 to 20), in the arrangement shown in FIGS. 15 and 16, a first operating step occurs through the magnet 89, and shortly thereafter the magnet 99 is energized through a timing device 46, the type lever 83 thus being actuated; at practically the same time as the type lever 83 swings upwards, the electro-magnet 68 is energized by way of a timing device 46*a* and the catch plate sets consisting of frames 51 to 54 are moved as described below, while the actuated key is moved back to its initial rest position.

When the pole shoe 22 is pushed back by the frame 54, the contact between the contact pole 45 and the upper end 35*a* of the rocker plate 35' (FIG. 4) is immediately interrupted and so, therefore, is the flow of current in the main circuit 43 (FIG. 6), since the rocker plate 35' is entrained by the magnetic pole shoe 22 due to magnetic forces of attraction. Interruption of the voltage in the main circuit 43 results in the triggering of a further timing member 46*b*, for example by the pulse caused by the trailing voltage flank; thereupon a second electro-magnet 69 is energized through this timing member, and by means of this electro-magnet the catch plate set formed by the frames 51,52,53 and 54 as well as the catch plate set for the other group of keys are pushed back into their original positions as shown in FIG. 3 (and as will be further described in detail by reference to FIG. 13). The returned key remains in its rest position.

The well-known monoflop circuits may for example be used as the timing members.

In this arrangement, two sets of catch plates corresponding to the groups of keys 6 and 7 (FIG. 2) are provided; the set on the left comprising the above-mentioned catch plates 51 to 54 is for the left-hand group of keys 6, and the second set, comprising four catch plates 55 to 58, of which the top catch plate 55 and only part of the subjacent catch plates 56 to 58 are visible, is for the right-hand group of keys 7. Provided between the two sets of catch plates of the return device 50 is a pair of superposed four-arm levers 60 and 70; the upper lever 60 actuates the top and the third subjacent catch plate (51 and 53) of the left-hand set for the group of keys 6, and the corresponding catch plates (55 and 57) of the right-hand set for the group of keys 7, whereas the lower four-arm lever 70 actuates the second and fourth catch plate (52 and 54) of the left-hand set and the corresponding catch plates 56 and 58 of the right-hand set. For this purpose, the two four-arm levers 60 and 70 are pivotably mounted in the housing 1 on a common pivot pin 80 and are interconnected by a double-arm reversing lever 71 which in turn is pivotably mounted in the housing 1 on a pivot pin 72, and at its forward free lever end, i.e. that nearest the typist, this reversing lever is pivotably connected to the four-arm lever 60 by way of a pivot pin 73, and at its opposite rear lever end to the subjacent four-arm lever 70 by way of a pivot pin 74, and in one of the operating positions the pivot pin 73 is disposed somewhat to the left, and the pivot pin 74 somewhat to the right of the straight line extending through the pivot pins 72 and 80.

Of the four arms **60*a*,60*b*,60*c* and 60*d* of the return lever 60, the outer left arm 60*a* is pivotably connected, by way of the pivot pin 61*a*, to the top catch plate 51 of the left-hand set and is able to displace this catch plate 51 from its middle rest position in the direction indicated by the arrow D; the arm 60*b* extending half-right (the third from the left) is connected, through the pivot pin 61*b*, to the third subjacent catch plate 53 of the same set and is able to move this catch plate 53 in the direction indicated by the arrow A; the arm 60*c*, extending to the right, is connected, through the pivot pin 61*c*, to the top catch plate 55 of the right-hand set and is able to displace this catch plate in the direction indicated by the arrow C; and the fourth arm 60*d*, extending half-left, is connected, through the pivot pin 61*d*, to the third subjacent catch plate 57** of the right-hand set and is able to displace this catch plate in the direction indicated by the arrow A.

For the purpose of guiding the catch plates 51,52,55 and 56 in a reliable manner during their displacement caused by the swinging movement of the return lever 60, a double-arm guide lever 63 is mounted to pivot about a pivot pin 62 on the rear side of the catch plates in the housing 1, and to the left and right of this guide lever two single-arm guide levers 66 and 67 are provided and these are pivotably mounted on pivot pins 64 and 65 respectively in the housing 1.

Through these, the double-arm guide lever 63 is connected by the free end of its left arm and by way of a pivot pin **63*a* to the top catch plate 51 of the left set, and through the free end of its right arm and by way of a pivot pin 63*b*, to the top catch plate 55 of the right-hand set. The left single-arm guide lever 66 is pivotably connected, through its free end and by way of a pivot pin 66*a*, to the third catch plate 53 of the left-hand set, and the single-arm guide lever 67 on the right is pivotably connected through its free end and by way of a pivot pin 67*a* to the third catch plate 57** of the right-hand set.

In precisely the same way, the four-arm return lever 70, positioned below the return lever 60, is connected through its arm **70*a* to the second catch plate 52 which it is able to displace in the direction indicated by the arrow C, and through its arm 70*b* it is connected to the fourth catch plate 54 of the left-hand set, which catch plate it is able to displace in the direction of the arrow B; through its arm 70*c* it is connected to the second catch plate 56 of the right-hand set, which catch plate it can displace in the direction indicated by the arrow D', and finally, through its arm 70*d*, it is connected to the fourth catch plate 58 of the right-hand set, which catch plate it can displace in the direction indicated by the arrow B'. The second and fourth catch plates of the two sets are guided during their displacement by a double-arm guide lever 75, disposed below the double-arm guide lever 63 and mounted on the same pivot pin 62, and two single-arm guide levers 76 and 77, of which the lever 76 is mounted on the same pivot pin 64 as the guide lever 66, whereas the lever 77 is mounted on the same pivot pin 65 as the guide lever 67**.

Provided at the side of the electro-magnet 68, which attracts the return lever 60 when energized, is the second electro-magnet 69 which, for the purpose of returning the two sets of catch plates to their initial position, swings the return lever 60 in the opposite rotary direction about a pivot pin 80.

In this arrangement, the electro-magnet 68 is preferably fitted opposite the free end of the arm **60*a* and, when current flows, attracts, through its core 68*a*, the magnet shoe 68*b* secured to the arm 60*a*, whereas the electro-magnet 69 is fitted opposite the free end of the arm 60*c* of the return lever 60 that extends away from the arm 60*a*, and when current flows and thus energizes its iron core 69*a*, this electro-magnet attracts the magnet pole shoe 69*b* carried on the arm 60*c***.

The actions occurring during the return of a key into its rest position and illustrated purely diagrammatically in FIGS. 11 and 12 are as follows in the case of the keyboard illustrated in FIG. 13:

If the key **8*b* on the keyboard shown in FIG. 13 has been tilted to the left (i.e. as seen by the operator) and in the direction indicated by the arrow A in FIG. 11 and has typed a letter or other symbol, the electro-magnet 68, as described in detail above, is energized and attracts the arm 60*a* of the four-arm return lever 60. By its free end and via the pivot pin 61*a* thereon, the return lever pulls the catch plate 51 in the direction indicated by the arrow D, whereas the lever arm 60*b* displaces the catch plate 53 in the direction indicated by the arrow A, the lever arm 60*c* displaces the catch plate 55 in the direction indicated by the arrow C', and the lever arm 60*d* moves the catch plate 57 in the direction indicated by the arrow A' over the same distance through which the key 8*b*** has been tilted in the direction of the arrow A.

When the return lever 60 swings about the pivot pin 80, the pivot pin 73 on the lever 60 follows this swinging movement in the direction indicated by the arrow L and transmits the movement to the transfer lever 71 having a slot **73*a* in which the pivot pin 73 engages. As this happens, the pivot pin 73 swings the lever 71 about the pivot pin 72 likewise in the direction indicated by the arrow L, the opposite end of the lever 71 swinging in the direction indicated by the arrow R. This swinging movement is transmitted through the pivot pin 74 to the four-arm return lever 70 which carries it and which then, by its arm 70***a*, displaces the second catch plate 52 of the left set in the direction indicated by the arrow C, by its arm 70*b*, the fourth catch plate 54 of the left-hand set in the direction indicated by the arrow B, by its arm 70*c*, the second catch plate 56 of the right-hand set in the direction indicated by the arrow D', and, by its arm 70*d*, the fourth catch plate 58 of the right-hand set in the direction indicated by the arrow B'.

By this arrangement it is possible to bend the third catch plates 53 and 57 and the subjacent fourth catch plates 54 and 58, forwardly of the normal row of keys of each group, downwardly at a right-angle by their front portions 53*x*,54*x*, 57*x* and 58*x*, so that they can also serve as frames for the return of, or for limiting displacement in the directions indicated by the arrows A and B of the horizontally mounted key rods 94 of the previously described keys 90 of the third type (FIGS. 10,10A, 13 and 14).

Formed in the top and second catch plates 51 and 52 and 55 and 56 respectively, are slots 90*a* and 90*b* which, as seen by the typist, are located in front of the windows 51*a*, 52*a* and 55*a*, 56*a* respectively for the keys of the normal row; the slots 90*a* in the top catch plates 51 and 55 respectively register with slots 90*b* in the subjacent second catch plates 52 and 56 respectively. As indicated for one particular case, a key 90 of the third type which is actuated by the middle finger extends through these slots. The slots of sufficient length to permit tilting of the key 90 in the direction indicated by the arrow A or B (FIG. 10). The ends of their rods 94, which carry the balls 26, extend forwardly towards the typist in order not to be in the way of the downwardly extending rods 24 of the keys 20 of the normal row to the rear thereof. The balls 26 carried by their pole shoes. 95 (FIG. 10A) or the knuckle joints corresponding to these balls are mounted in a transverse wall 1*a* of the housing 1 in an otherwise similar manner to that described in the case of the key 20 (FIG. 3).

If one of the keys 90 is swung in the direction indicated by the arrow A (FIG. 10), it is returned by the catch plate 54, which is moved in the direction indicated by the arrow B when the electro-magnet 68 is energized (in a similar manner to that shown in FIGS. 11 and 12), since it bears against this catch plate at one side of the window 94*a* in the angled part 54*x*.

In contrast to the keys 8*a* to 8*d* of the normal row, the keys 9*a* to 9*d* and the keys 10*a* to 10*c*, which are actuated by the middle joint of a finger (actuating unit 90), are displaceable in three directions only. Movement in the fourth, prohibited, direction is easily prevented in the case of the keys 9*a* to 9*d* by the screen 40 which in this case has no cut-away portions 41 in that side 40*a* (FIG. 14) facing the key 9, though such cut-away portions are provided on the opposite side. The actuating unit 90, used as keys 10, is also provided with a screen 91 which advantageously takes the form of an angled piece and is secured to the base of the housing 1 by a retaining screw 49.

The screen 91 has a window 91*a* through which projects the pole shoe 97 which is secured to the swinging end of the key rod 94. The pole shoe 97 closely surrounds the base 98 of the actuating unit 90, into which base is firmly inserted the key rod 90*c* which extends downwardly through the slots 90*a* and 90*b*. On its downwardly facing side, the pole shoe 97 carries the contact pole 97*a* which bears on the contact pole 92*a* and closes the circuit 59 when the key 90 is depressed.

Whereas the screen 91 has, in the lower, right-hand and left-hand edges of its window 91*a*, cut-away portions 42 corresponding to the cut-away portions 41 in the window of the screen 40, no such cut-away portion is present at the upper side of the window 91*a*. This renders it unnecessary to provide a special catch plate whereby the return movement of the key rod 94 in the direction indicated by the arrow F, i.e. in the upward direction, is limited. Instead only one vertical catch plate 51*x* is required.

Depression of the key 90, whereby the compression spring 93 is compressed, and return of the key into its FIG. 10 rest position by upward movement from the depressed position then occur with the aid of the return 51*x*, which is disposed at right-angles to the longitudinal axis of the key rod 94 and in front of and parallel to the angled front parts 53*x* and 57*x*; the return plate is connected, by a right-angled toggle lever 78 having equal arms, to the catch plate 51, the pivot pin 79 of this lever, that is mounted in the transverse wall 1*b* of the housing 1, being disposed at such distance below the catch plate 51 that its arm 78, connected to the catch plate 51, forms a right-angle with said catch plate in the rest position, whereas the other arm 78*b* of the lever, which is pivotably connected to the vertical catch plate 51*x*, projects rearwardly, i.e. away from the person using the keyboard (FIG. 14).

In this arrangement, the pivot pins 81*a* and 81*b* which are connected to the free ends of the lever arms 78*a* and 78*b* and are fitted on the end faces of the catch plates 51 and 51*x* respectively, project into longitudinal holes or slots 82*a* and 82*b* which are formed at the free ends of the above-mentioned lever arms 78*a* and 78*b*.

If as previously described, the catch plate 51 is now displaced forwardly from its middle rest position in the direction indicated by the arrow D, it carries the arm 78*a* of the toggle lever 78 forward with it by means of its pivot pin 81*a* displaceable in the slot 82*a*, and the rearwardly projecting arm 78*b* of this lever then in turn lifts the pivot pin 81*b*, displaceable in the slot 82*b*, and therefore also moves the vertical catch plate 51*x* upwards in the direction indicated by the arrow F until the pole shoe 97 strikes the upper edge of the window 91*a* that has no cut-away portion. It is held in this rest position by the compression spring 93.

In a corresponding manner, the three keys 10 of the right-hand key group 7, which are actuable by the middle joints of the index finger, middle finger and ring finger are also provided with a vertical catch plate (not shown) which is disposed in front of the rearwardly angled front sides 57*x* and 58*x*, which catch plate is actuated by a right-angled toggle lever (not shown) having equal arms and arranged in precisely the same manner.

The vertical catch plate 51*x* of the key group 6 and the above-mentioned vertical catch plate of the key group 7 have been omitted from FIG. 13 for the sake of greater clarity.

When the key 90 is depressed to close the circuit between the contact poles 97*a* and 92*a* (the latter in the housing 1, see FIG. 10), the resistance to magnetic attraction between the pole shoe 97 and the adjacent free end of the rocker plate 35*z*, extending above the key rod 94 and mounted in the pole shoe 95, has to be overcome. Near the position at which it bears against the pole shoe 97, this rocker plate is mounted in an upright 48, which can be firmly connected to the frame 1 or made integral therewith, and the rocker plate is so mounted that it cannot rise or drop since it is inserted between the arms 48*a* and 48*b* of a bifurcated portion, open at one side and formed at the upper end of the upright 48.

When all the keys of the two groups 6 and 7 have been secured in their middle rest positions, the flow of current is interrupted, but the second electro-magnet 69 is briefly energized through the timing member 46*b* and attracts the arm 60*c* of the four-arm return lever 60 and thus returns the last-mentioned lever to the initial position shown in FIG. 13 in which all the keys are disposed centrally in their associated windows 51*a* etc. of the catch plates, and at a uniform distance from all the sides of the frames containing the windows, since by means of the return lever 60, the first and third catch plates of both sets and, by means of the transfer lever 71 and the four-arm return lever 70, also the second and third catch plates of the two sets are brought back to the unactuated position shown in FIG. 13. Compression springs 100 and 101, which engage the base 98 of the key and the pole shoe 95 respectively, prevent each ball 26 from dropping out of the seat 27 (FIG. 14).

FIG. 15 shows a side view of a type arm of a typewriter together with the associated release means and the roller 2 of the typewriter, whereas.

FIG. 16 shows detail of the FIG. 15 arrangement at another operating stage.

A selector member 85 designed as shown in FIG. 15 is rotatably mounted on the type arm 83 by means of a pivot 85*b*. The selector member 85 has a rearwardly projecting part which, by means of a spring 88, is connected to the arm 83 in such manner that the spring 88 pulls the member 85 towards the arm 83 into the position shown in FIG. 15. The member 85 also has a forwardly projecting locking arm or lever 85*a*. In the unactuated position shown in FIG. 15, the end of the locking lever 85*a* strikes, with each effort to swing the arm 83 up towards the roller 2, a support bridge 84, on which the type arm 83 rests, a leather strip being interposed between said bridge and the type arm.

The electro-magnet 89 (FIG. 6) is positioned below the selector member 85. Its winding receives current when for example that key 20 which corresponds to the arm 83, is tilted. Thus, an electro-magnet 89 must be provided for each key and therefore for each type arm 83. When current is flowing in the electro-magnet 89, the member 85 is attracted, tilts about the pivot pin 85*b* and is swung against the action of the spring 88. As this takes place, the locking lever 85*a* is swung upwardly into the position indicated in FIG. 16 in the rotary direction indicated by an arrow in FIG. 15. The locking lever 85*a* then prevents the arm 83 from continuing to swing upwards.

When the selector member 85, by its above-described movement towards the electro-magnet 89, releases the lock on the arm 83, a shoulder 85*c* formed on the member 85 swings downwards at the same time so that it lies in the path of movement of a striker arm or striker rail 86. It is possible to provide one stricker rail 86, common to all the type arms, or one striker rail for each of several groups of type arms. The striker rail 86 is moved by means of a solenoid 99, the magnet armature being secured to the striker rail and being drawn into the winding 99*a* of the solenoid 99 when the armature receives energizing current. The striker rail 86 is held in its rest position by a return spring 87.

Figure 6:
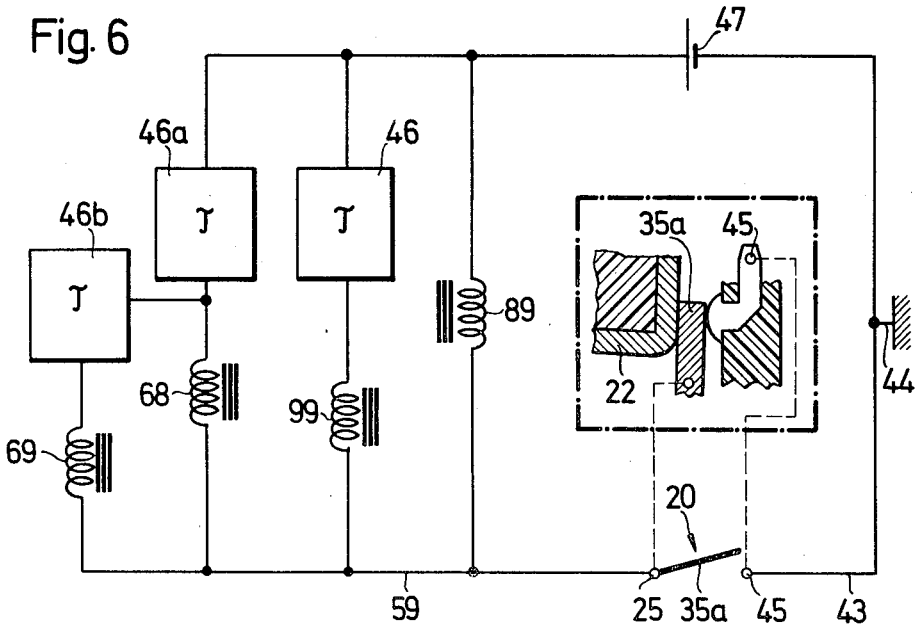
FIG. 6 illustrates diagrammatically a control circuit for an actuating unit as shown in FIG. 3.
Figure 7:
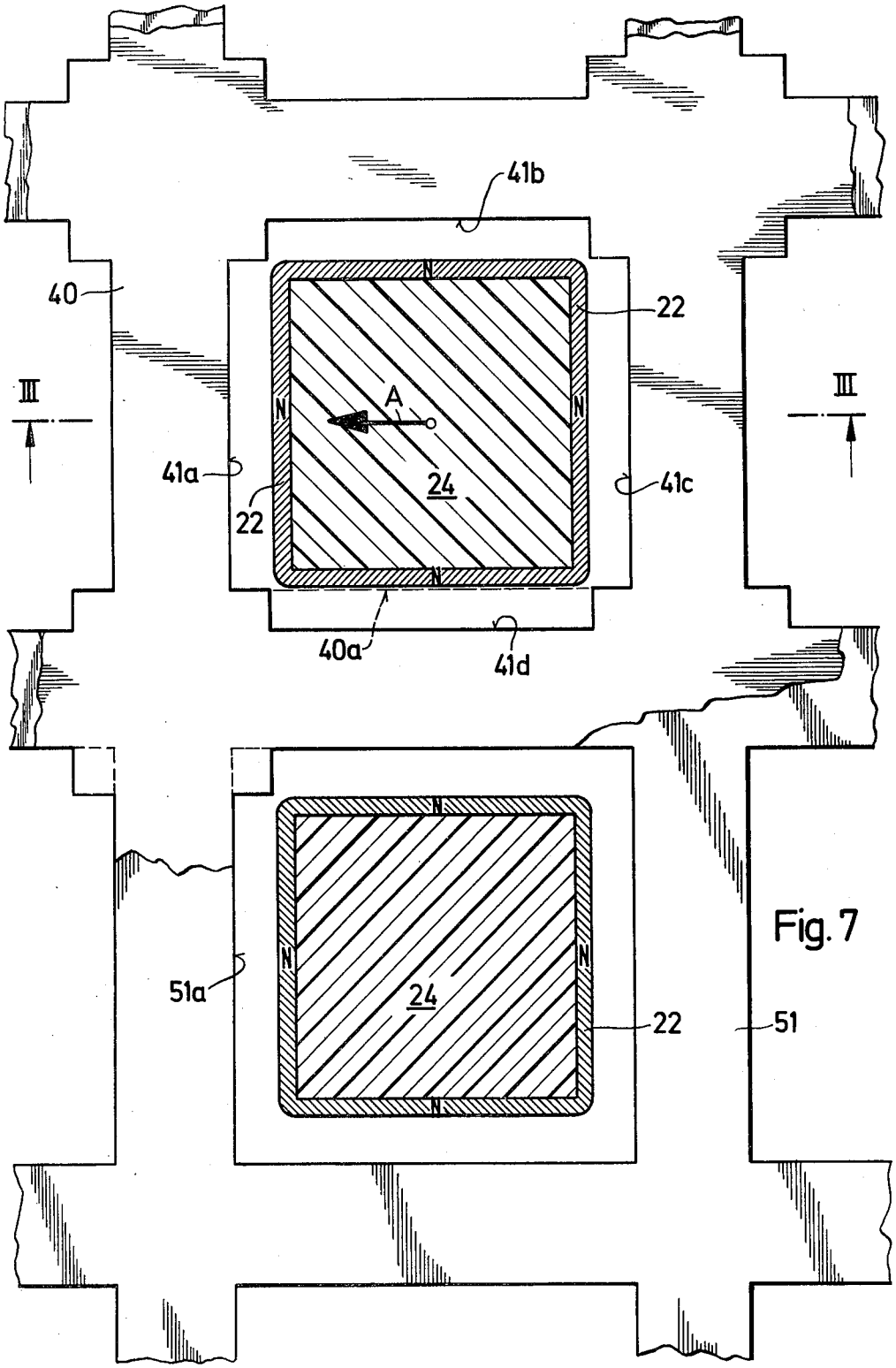
FIG. 7 illustrates a preferred form of the guide device for the actuating unit, and, in cross-section, two actuating devices for the FIG. 2 keyboard along a plane designated by the numerals VII—VII in FIG. 3.

The mode of operation of the apparatus described is as follows: When a typewriter key in accordance with the invention is tilted, the circuit 43 is closed by way of the winding of the coil of the electro-magnet 89 (FIG. 6). The member 85 is drawn downwards from the position shown in FIG. 15 into that illustrated in FIG. 16. As this takes place, the lock is released by the locking lever 85*a* on the one hand, and the shoulder 85*c* is moved into the path of movement of the striker rail 86, on the other. Immediately after current has been supplied to the coil of the electro-magnet 89, current is fed to the coil 99*a* through the timing device 46, so that the striker rail 86 is thrown forward and, by its striking edge 86*a*, encounters the shoulder 85*c*. This causes the type arm 83 to be thrown upwards against the roller 2 to execute the typing stroke.

As mentioned above, in the rest position, there is no mechanical connection between the striker rail and the type arm with its associated members. As soon as the striker rail has delivered a pulsed blow to the member 85 on the arm 83, the spring 87 is able to return the striker rail 86 to its initial position where it lies ready to deliver a fresh blow. With each blow a type arm 83 is thrown upwards against the roller, and a plurality of type arms can thus, without difficulty, be on their way to the roller at the same time and/or be returning from the roller if simultaneous striking of the roller is prevented. A very high typing speed can therefore be achieved by this independent connection between the effective parts.

The arrangement illustrated diagrammatically in the drawing is simply intended to explain the ideas underlying the invention and in no way to limit it to what is illustrated and described. The selector and locking member 85 may for example be of any one of a numer of modified forms which fall within the scope of the idea underlying the invention and are left to the choice of the person skilled in the art.

The need for a slight delay in the actuation of the striker device 86 with respect to the action of the member 85 can be met with the aid of electrical and/or mechanical means.

In contrast to the use of the keyboard of the invention illustrated in FIGS. 15 and 16, FIGS. 17 to 20 illustrate an electric typewriter having simplified means for connecting it to the keyboard in accordance with the invention.

Figures 17, 20:
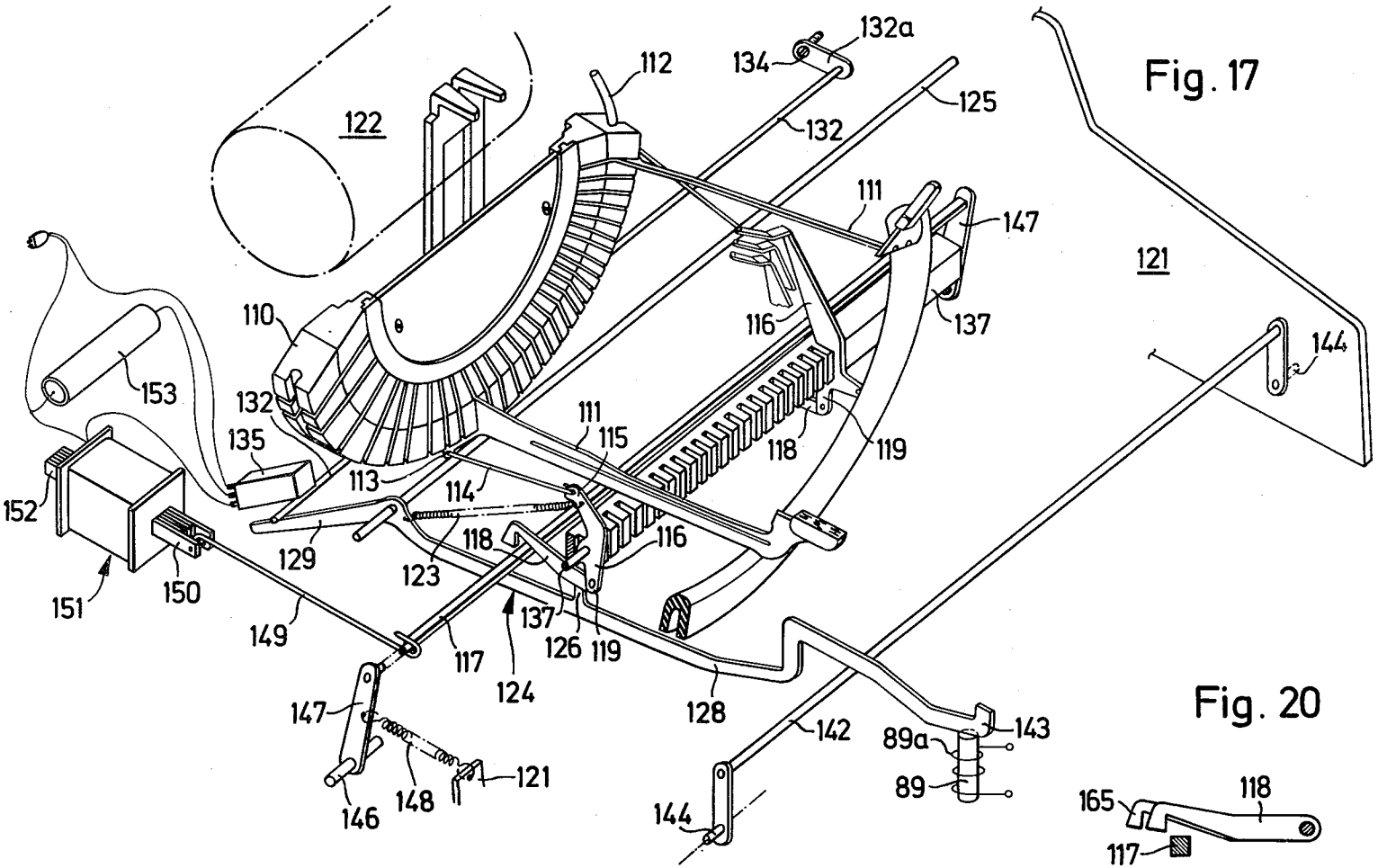
FIG. 17 is a perspective partial view.
FIG. 20 shows, in side view, a single unit from FIG. 18.

The typewriter illustrated in these Figures comprises a segmental element 110 in which gaps are formed and which carries the type levers 111 which are arranged in an arc of a circle and can be swung into the gaps in the segmental element on a bent steel wire 112, so that they are able to execute striking movements of the same amplitude and range. The type levers 111, only two of which are illustrated in FIG. 17, each comprise a short lower arm 113 which is mounted to swing on the rear end of a strut 114, one of the latter being provided for each type lever; on the other hand, the other end of each strut is mounted to swivel on the upper end 115 of an angled lever 116.

As explained below, the above-described type lever arrangement is coupled to an oscillating rail 117 by hook members 118 which are mounted to swing on a lower arm 119 of the lever 116.

The oscillating rail 117 is horizontally mounted below the hook member 118 in the typewriter frame 121 and it serves to pull the individual type-lever arrangements towards the roller 122 by means of their particular hook members 118, and when this takes place the hook members continue their movement, so initiated, under the effect of gravity and against the action of a return spring 123, which latter engages the upper arm 115 of the lever 116 and finally pulls this back into its rest position.

The return spring 123 is mounted at its other end on the key lever 124 and forwardly of the pivot of the latter on the key-lever shaft 125 which is in turn mounted on the typewriter frame 121.

In contrast to the mode of operation of the electric typewriter described in Swiss Pat. No. 353,021 by the Royal McBee Corporation, wherein each of the key levers to be actuated has to be depressed by light finger-pressure applied to the key fitted on the front upwardly extending free end of the key lever 124, when this typewriter is equipped with the keyboard in accordance with the invention, downward movement of the key lever 124 at its front end is achieved by downward attraction by the moving-coil magnet 89 following energization of the coil 89*a* (FIG. 6).

Otherwise, all the operating movements occurring in the typewriter are carried out as described in the above-mentioned Swiss Patent.

When the key levers 124 swing about the shaft 125, the hook members 118 of the corresponding type-lever arrangements are pushed into the field of action of the oscillating rail 117 by abutments 126 which are mounted on the upper sides 127 of the forwardly extending arms 128 of the key levers 124, and thereupon, under the action of the rearwardly directed arm 129 of each key lever 124, are used to actuate the oscillating rail 117 as will be described hereunder.

The key levers 124 are normally biased into their rest position by the action of return tension springs 131 (FIG. 18) suspended in the frame 121, it being possible to vary the tension of these springs in the customary manner. The rear arms 129 of the key levers 124 all lie, when in the rest position, against the lower face of a horizontal bar 132, which is mounted on pivot pins 134 in the frame 121 by means or rocker arms 132*a* carried on its ends.

A two-way single-pole circuit breaker 135 is fitted above the bar 132 in its field of movement, so that, upon displacement of the bar 132 which is caused by upward movement of the free arm 129 of the key lever 124 due to downward movement of the front key-lever arm 128, the bar encounters a spring-loaded pip 136 (FIG. 18) and thus triggers off the circuit breaker 135.

The toggle levers 116 are all arranged to swing about a horizontal shaft 137 which is incorporated in the typewriter frame 121 in the customary manner.

The downward movement of the front arms 128 of the key levers 124 is limited in one of two positions by a horizontal retaining rail 142 which is provided below the key levers 124 and towards those ends thereof that carry the moving-coil magnets 189; the retaining rail 142 is mounted to swing about pivot pins 144 secured in the frame 121. In this arrangement, the lower faces 143 of the front key-lever arms 128 are all at the same distance from the retaining rail 142 when in the rest position.

Figure 18:
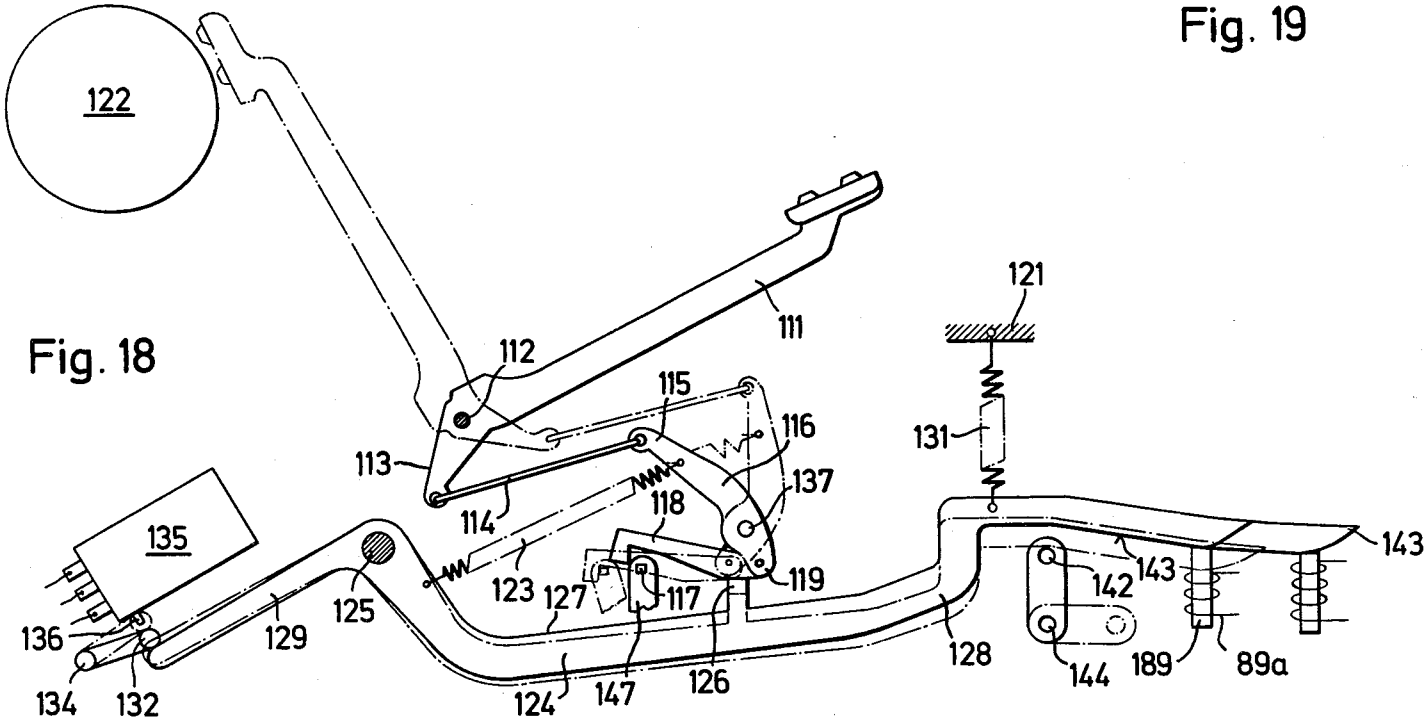
FIG. 18 is a side view of a key and type unit.

In FIG. 18, the key-lever and type-lever mechanism is illustrated by solid lines for when it is in the rest position, and in broken lines for when it is in the actuated position.

As shown in FIG. 17, the oscillating rail 117 is mounted at its two free ends in the upper free end of a single-arm carrier lever 147, the lower end of which is swingably mounted on a pivot pin 146 in the frame 121 and is retained in the rest position by a return spring 148 which in turn is suspended by one end in the frame 121.

In this arrangement, the oscillating rail 117 is itself connected through a connecting rod 149 to the core 150 of a solenoid 151 incorporated in the frame 121 of the typewriter, so that when the solenoid is energized, the core is rapidly attracted by an armature 152, and entrains the oscillating rail 117 in the rearward direction.

Figure 19:
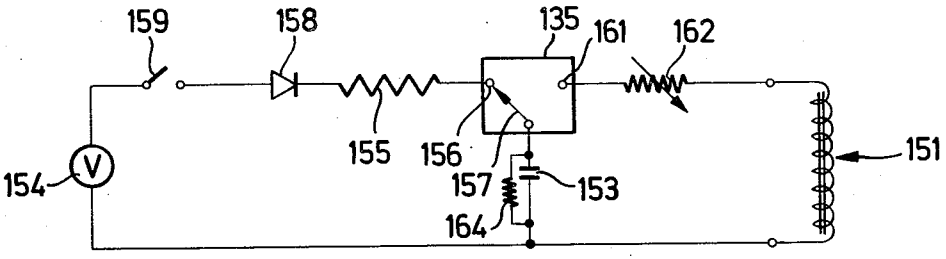
FIG. 19 illustrates an associated electric circuit diagramm.

The electric circuit for actuating the horizontal rod 132 at a particular frequency and by means of the solenoid 151 is illustrated in FIG. 19 and, apart from this solenoid, it incorporates a circuit breaker 135 and a condenser 153 which is connected to the terminal of an A.C. source 154 through a resistor 155 as well as through a fixed contact 156 and a moving contact 157 of the circuit breaker 135.

In the charging circuit of the condenser 153 is provided a rectifier 158 which rectifies one or both of the A.C. phases and which drops when the operating circuit is connected to a D.C. source.

When the switch 159 is closed, the condenser 153 is momentarily charged since the time constant R.C. of the charging circuit is very small. The solenoid 151 is connected to one of the two contacts of the condenser 153 by way of the moving contact 157, a second fixed contact pole 161 of the circuit breaker 135, and a rheostat 162, and is connected directly to the other side of the condenser 153.

A high-duty by-pass resistor 164, connected in parallel, can be used in the customary manner for shunting the condenser charge.

The typewriter functions as follows: When the switch 159 is moved to the on position, the condenser 153 is charged. Downward movement of the front arm 128 of a key lever 124 brings the hooked end of the hook member 118 associated therewith into the zone of action of the oscillating rail 117. Further downward movement of the key lever 124 into abutment with the retaining rail 142 moves the rear arm 129 of the key lever 124 upwards while the horizontal bar 132 is raised and this in turn depresses the pip 136 which is connected to the movable contact 157 of the circuit breaker 135 and moves this into contact with the fixed contact pole 161, so that the solenoid 151 is connected to the terminals of the condenser 153. The solenoid 151 is immediately energized by the charge flowing from the condenser and pulls up the core 150 so that the oscillating rail 117 and, with it, also the hook member 118 of the actuated key are pulled rearwards by the connecting rod 149. The toggle lever 116 of the corresponding type-lever arrangement is thus swung about the horizontal shaft 137 in the clockwise direction (from the position shown in solid lines in FIG. 18 to the position shown in broken lines), and thereby its longer arm 115, by way of the strut 114, swings the type lever 111 with considerable momentum so that it strikes the roller 122.

Because of the return swing of the oscillating rail 117, which, upon discharge from the condenser 153 and interruption of the flow of current through the solenoid 151 due to release of the pip 136 and therefore the return swing of the movable contact 157 from the pole 161 to the fixed contact pole 156, is swung back into its initial position under the action of the return spring 148, the hook member 118 is already released, whereas the type lever, due to its moment of inertia, completes its swinging movement towards the roller 122.

Then, because the release of the hook member 118 has been completed, the type lever 111 can be returned to its initial position by the return spring 123.

Also, the key lever 124, which, when pressed directly with the finger (FIG. 2 of Swiss Pat. No. 353,021), can only be moved into its rest position by the return tension spring 131 when the finger releases the key, is automatically, and without conscious release by the operator, freed and returned by the spring 131 when the keyboard in accordance with the present invention is used, since the electromagnet 68 moves all the catch plates (FIGS. 13 and 14) only after a delay determined by the timing device 46*a* and returns the actuated key 20 or 90 in a positive manner. However, the contact between the contact pole 45 and the magnetic rocker plate 35*a* (FIGS. 3 and 6) and therefore also the flow of current through the operating circuit 43 are hereby interrupted, and the key lever 124 can be returned to its rest position by the spring 131.

In this system, no other key lever 124 can be actuated before all the catch plates have returned to their initial positions.

As the key lever 124 returns to its initial position under the action of the spring 131, its abutment 126 pushes the associated hook member 118 out of the zone of action of the oscillating rail 117 and back into its initial position, and this return movement is facilitated by the swinging of the toggle lever 116 under the action of its return spring 123. As in the known electric typewriter disclosed in Swiss Patent Specification No. 353,021, it is possible to vary the length of arc over which the type lever is actuated and to vary the acceleration imparted to it thereby by altering the period during which the hooked end of the hook member 118 engages on the oscillating rail 117, this being done by providing the hook member 118 with a longer or shorter hooked end 165 as shown diagrammatically in FIG. 20.

Also, the force with which the types strike the roller 122 can be varied in the manner described in the above-mentioned Swiss Patent Specification, by varying the force of attraction of the solenoid 151.

The above-described keyboard in accordance with the invention enables one or both of the hands used to operate it to be rested on the thumb-ball support or supports, whereas the thumb of the hand rests on its thumb key and the tips of the index finger, middle finger, ring finger and little finger (hereinafter called the "active" fingers) rest on the keys of the normal row that are allotted to them and can remain thereon under any required pressure without moving these keys.

Without the wrist being removed from its support, all the key positions can now be reached by the above-mentioned four active fingers without any strain, whereas, with the hand resting in a natural manner, the thumbs can be held above a customary space bar and can be pressed downwards undeliberately or for the purpose of moving the roller or for changing from lower-case to upper-case letters. The fact that the four active fingers of the hand or hands required for actuating the keyboard are able to rest with pressure on their keys without actuating them enables the thumb or thumbs to be pressed down more easily for the purpose of moving the actuating bar or key allotted to the thumb or thumbs.

Whereas, in the known typewriter systems equipped with Latin or Cyrillic letters, e.g. the electric IBM Standard Typewriter, 44 keys are provided whereby, by shifting, 88 different letters, numbers, punctuation signs and other symbols can be struck, with the keyboard in accordance with the invention, $37 \times 2 = 74$ "strikes" are possible for each hand when doubling by means of the known shift device, and for both hands together 148 different letters, numbers, punctuation signs or other symbols can be struck (FIG. 2).

Even with a simplified keyboard in accordance with the invention, which does not include the key unit 10*a*, 10*b* and 10*c* which can be actuated by the middle joint of three fingers of each hand, thus permitting a considerably simpler and less expensive design of the sets of catch plates, 56 "strikes" are still available for each hand and 112 for the two hands together, i.e. 24 more than in the above-mentioned known typewriter.

However, this increase in the number of symbols that can be struck is only a secondary advantage provided by the nature of the new actuating units.

What is revolutionary is the ease with which touch-typing can be learned with this keyboard. Because of the fact that the thumb-balls always remain on their supports during typing using this keyboard, the four active fingers of each hand have fixed resting points on the normal row and similar resting points on the adjacent row of keys to the rear, each finger resting in the middle of the head of a key.

Whereas, when learning touch-typing on known machines and with the tips of the four or eight active fingers hovering over the keys, each hand must be to some extend directed to hover in front of the machine with the aid of the muscles of upper arm and fore-arm, and the fingers of each hand of the person practising touch-typing must seek, find and strike the required key from a fairly large number e.g. six for each index finger, usually five for the weakest i.e. the little finger, and only as few as three in the case of the middle finger and ring finger, all this being dependent upon the unstable hovering position of the wrists in front of the typewriter and requiring considerable and constant concentration and strain on the brain, nerves and muscles, these physiological requirements in the typist are reduced to a minimum when the new keyboard in accordance with the invention is used.

Whilst the wrists are able to rest, without any strain on the muscles of the upper arm and fore-arm, because of the presence of the supports for the thumb-balls, the activities of the active fingers on the normal row are limited to extremely small displacements of the finger tips forwardly or rearwardly and to the right or to the left.

Even the "finding" of the key in the rear row that is disposed somewhat higher and to the rear requires only a slight degree of forward stretch and displacement of the finger-tip from its rest position on its key in the normal row into the new rest position on the key in the second row, which key is located above and to the rear of the key in the normal row.

In order finally to actuate the underlying key of the front third row using the middle joint of the same finger, the finger in question has only to be extended and the key pressed downwards or to the right or to the left using that finger. In this action, the distance over which the middle joint of the finger has to be swung downwardly or to the right or to the left is so small that most people can learn to do this as a matter of course.

However, the people who have too little flexibility or power in their active fingers can confine themselves to typing using a keyboard which does not include the last-mentioned third row of keys. It is in fact even possible, in the case of persons having particularly weak or insufficiently flexible little fingers, to reduce the number of possible ways in which the keys provided for these fingers i.e. the keys in the left-hand group 6 and the right-hand group 7, can swing. It would even be possible, though hardly desirable, for physiological reasons, to omit or immobilize the two extreme keys in each group. Eighty-four possible strikes or swinging movements would then still remain i.e. almost as many as in the above-mentioned standard typewriter. However, at least on swinging movement must be expected even of the weakest little finger, and, if the key in the second rear row, that is intended to be operated by the little finger, is omitted, there are still four symbols which have to be typed by the two little fingers and therefore a total number of 88 symbols is again present as in the known typewriters.

A further special advantage of the new keyboard resides in the fact that each active finger has to execute a different kind of movement for each of the symbols that it is able to type, whereas in the known keyboards, the same uniform movement for applying pressure to a key has to be repeatedly carried out by each finger. This runs counter to the natural need of each muscle to alter its movement.

It is of extreme importance as regards ease of learning and in carrying out work reliably and with very few errors, that there should be provided a particular symbol for each finger inclusive of the direction in which its tip is to execute movement, which symbol should not be repeated elsewhere on the entire keyboard for this combination of a particular finger and of a particular direction of movement thereof. In contrast to this, in all of the existing known keyboards, a plurality of symbols is allotted in each case to the same finger and to the same type and direction of movement.

Since the return movement of the catch plates starts within a fraction of a second after contact has been established in a first actuating unit on the keyboard of the invention, the catch plates prevent a key unit that is subsequently actuated for too short a period from executing the full swinging movement. An almost simultaneous striking of a plurality of keys accompanied by jamming of the type levers, such as can still always occur in the known electric typewriters, is thus inhibited.

Particularly advantageous for carrying out forward or rearward, right-hand or left-hand movements of the finger-tip on a key in the new keyboard is the fact that the key is of concave form with substantially vertical rims, so that the finger-tips rest on a shallow concave central surface of the key when executing one of the above-mentioned movements, but are firmly supported against the rim of the key.

In known typewriters and even in those of the type described above by reference to FIGS. 18 to 20, it is necessary for the typist to overcome the resistance offered by the tension spring 131 when depressing the key. This may result in the key not being depressed far enough for its action to be fully initiated. On the other hand, with a key as provided on the keyboard in accordance with the invention, it is necessary to overcome a minimum initial resistance which is offered by the magnetic attraction between the pole shoe, located directly below the key, and the upper end of the magnetic rocker plate bearing thereon, whereupon however, the swinging movement, once initiated by the severing of the magnetic connection, must then proceed in a positive manner until the action is completed, i.e. until the upper end of the magnetic rocker plate encounters the contact pole in the adjoining supporting element.

The optimum return speed of the key through the set of catch plates is that at which a type lever, previously set in motion, has had just sufficient time to move back towards its rest position that it affords passages to an adjacent type lever actuated consequently to it, in order thus to avoid collision of two type levers. This optimum return speed can be achieved by suiting the conditions relating to the mass of the catch plates to the force of the electro-magnets 86 and 89 (FIG. 13) which actuate them. In this connection, these magnets are so rated and connected that the sets of catch plates immediately return to their initial positions so as to release all the keys for further typing.

A further advantage of the novel keyboard resides in the fact that the keys in each row are not arranged along a straight line but instead, for each hand, they are arranged on a curve which corresponds to the natural position of the finger-tips in the slightly curved position of the fingers and when resting the wrists on their supports.

The following manipulations may be allotted to the thumbs:

left thumb: shift-key and holding key, half-spacing, tabulator;

right-thumb: operation of dead key, back-spacing and release.

Carriage-return can also be carried out by the thumbs. Some of these functions however can also be carried out by achieving contact by means of the little finger of the left or right hand and by swinging that key in the normal row or of the second row to the rear that is associated with said finger, so that as in known machines, operation of the dead key and, in addition, carriage-return can be carried out by means of the thumbs.

The possible uses of the new keyboard are very numerous. Although its use on electric typewriters has been described in detail, it can be employed just as readily in conjunction with automatic calculators, typesetting machines, punched-card perforators, telex machines and, in particular, any kind of apparatus wherein keys have to be actuated with several fingers to feed in signals. The only condition is of course that either no mechanical power is required as in small electronic computers, or that the required mechanical power is provided by a motor as is the case with the above-described electric typewriters.

I claim:

1. In a keyboard, actuatable with the aid of the tips of fingers of at least one hand, which keyboard comprises a support frame, a first row of key units, each of which comprises a key being movable out of an initial inoperative position in which the tips of the index finger, middle finger, ring finger and little finger, respectively, rest on the keys of said first row, the keys of said first row for each hand to be used for operating the keyboard being arranged on a curve, which corresponds to the natural disposition of the finger-tips when the fingers are, without being tensioned, in a slightly curved and spread, but relaxed posture, the improvement of the key of each key unit of said first row having a key rod and a top face on one end of said key rod and destined for having the tip of a finger rest thereon, and, at the end of said key rod opposite said top face, non-depressable mounting means articulatedly lodged in said support frame and being adapted for preventing downward depression of said key while permitting lateral shifting of said key toward at least one determined operational position, thereby permitting random vertical pressure to be exercised by a finger tip on said top face of a key of said first row without causing operational displacement of the latter key, each key unit of said guide key row further comprising:

(a) attracting means adjacent one side of said key, near the end of said key rod bearing said top face and facing away from said operational position, and adapted for exercising a determined initial attraction on said top face-bearing key rod end opposing tilting movement of said key away from said attracting means, when such movement is initiated by a finger tip resting on the top face of said key; and (b) stop means associated with said attracting means and preventing the latter from following said tilting movement of said key, thereby decreasing the attractive force of said attracting means as the distance of said key therefrom increases due to progress of said lateral tilting movement of said key, and thereby causing said finger tip to tilt said key further until the latter is fully shifted to said operational position.

2. A key unit as described in claim 1, wherein said key rod is mounted is said support frame, in a rest position at right angles to a bearing plane of said support frame, and said unit further comprises at least one contact switch having a stationary and a movable contactor, said key rod bearing said movable contactor near the tiltable key-bearing end thereof, an electrical operating circuit into which said switch is inserted, said switch being opened in a rest position of the key without making contact, thereby interrupting the flow of current through said operating circuit, and being closable by movement of said key away from said rest position, thereby making contact and thereby closing said operating circuit, and said movable contact being so disposed on said key rod as to make electrical contact when said key and key rod are tilted out of their rest position by means of movement of the finger-tip.

3. A key unit as described in claim 2, comprising a plurality of said contact switches about said key rod, and a guide device which permits said key and key rod to be tilted only towards one of the stationary contactors of said contact switches, said guide device comprising a screen which surrounds the key rod and has cut-away portions, with each of which is associated one of the directions of tilting of the key from its rest position, so that the key can be moved into only one of these cut-away portions each time for the purpose of making contact with a contact switch associated with the cut-away portion concerned.

4. A key unit as described in claim 1, wherein said key rod is of ferro-magnetic material, and said attracting means comprise a first ferro-magnetic attracting element arranged substantially parallel to said key rod, with opposite magnetic poles at the respective ends of said key rod and of said first ferro-magnetic attracting element facing one another, thereby establishing magnetic field lines attracting said key rod and said attracting means in inoperative as well as in operative position of said key.

5. A key unit as described in claim 4, further comprising (a) an electric circuit having a contactor in said support frame facing the side of said key rod away from said attracting means, (b) conduit means extending through said support frame and said mounting means lodged in the latter and ending at said key rod, and (c) contact-making means associated with the top face-bearing end of said key rod, whereby said electric circuit is closed, when said key is tilted and contact is established between said contactor and said contact-making means.

6. A key unit as described in claim 5, wherein said contact-making means comprise a second, electrically conductive attracting means lodged intermediate said contactor and said key rod, and second stop means associated with said second attracting means and preventing the latter from following said key when said key is tilted out of its inoperative position away from said contactor toward said first-mentioned attracting means.

7. A key unit as described in claim 6, wherein said second attracting means is a second ferro-magnetic element disposed substantially in parallel with said key rod, with opposite magnetic poles of said second ferro-magnetic element and of said key rod facing each other.

8. A key unit as described in claim 6, wherein said electric circuit further comprises a second contactor in said support frame facing said first-mentioned attracting means, the latter constituting a second contact-making means in said electric circuit.

9. A key unit as described in claim 8, wherein said first and second attracting means and their respective stop means are disposed on opposite sides of said key rod, and which unit further comprises a third and a fourth attracting means and third and fourth stop means respectively associated therewith, said third and fourth attracting means and stop means being disposed on opposite sides of said key rod, the latter sides extending at a right angle to the sides of said key rod facing respectively said first attracting means and first stop means, on one hand, and said second attracting means and second stop means, on the other hand, of said key rod.

10. A key unit as described in claim 1, wherein said mounting means comprise a ball joint for mounting said key rod in said supporting frame and an element for preventing the key rod from turning about its axis; or a knuckle joint, said ball joint or knuckle joint being mounted on that end of said key rod remote from said key.

11. An actuating unit as described in claim 1, further comprising a return device for moving the key from an actuated position into the rest position, the return movement of which device is initiated immediately upon completion of contact-making by the key, even when the finger-tip continues to exert tilting pressure, said return device comprising means for limiting movement whereby the returned key is arrested and retained in its rest position and prevented from passing through the latter in the direction toward another contact.

12. An actuating unit as described in claim 11, wherein said return element further comprises at least one pair of frames each having inner edges defining a window which frames are fitted opposite each other for movement in adjacent planes parallel to one another and surround the key rod, and drive means for moving the two frames toward and superimposing one another and comprising electric operating circuit means for causing said drive means to operate immediately upon the completion of contact-making, whereby when the key rod reaches its rest position, the frames bear simultaneously with those of their inner edges facing the key rod on the opposite sides of the latter to arrest said key rod in its rest position, one of the two frames of the said pair being moved in a direction opposite that in which the key has been moved for making contact, and the other being simultaneously moved in the last-mentioned direction by the drive means.

13. An actuating unit as described in claim 12, comprising at least one pair of oppositely disposed contact switches between which the key rod is centrally arranged, and two pairs of said frames, one pair of which frames is associated with the two contact switches and is displaceable along the line of movement passing through the two contact switches, whereas the second pair are displaceable at an angle to said line of movement.

14. An actuating unit as described in claim 13, comprising two of the said pairs of contact switches, there being associated with each of these pairs of contact switches a pair of said frames, the respective lines of contact which extends through the two pairs of contact switches forming a right-angle with one another.

15. An actuating unit as described in claim 14, wherein said drive means for moving the two frames of each pair of frames towards one another comprise (a) first electro-magnet means, (b) a secondary circuit in said operating circuit wherein said electro-magnet means is energized by the flow of current resulting from closing of the respective contact switch, (c) electrical switch means adapted for maintaining energization of said electro-magnetic means, even after the respective contact switch has again opened, until the respective key is fully returned to its rest position, and (d) second electro-magnetic means which is adapted to be energized when return movement of the key is completed thereby causing the frames of said pair of frames to move away from each other into their initial positions.

16. An actuating unit as described in claim 15, further comprising a control element adapted for offering, to the finger-pressure, an initial resistance which can be overcome by said pressure, but which, after having been overcome, immediately decreases rapidly when the tilting movement of said key begins, so that once the movement has been initiated it continues in a positive manner until the respective contact is closed.

17. An actuating unit as described in claim 16, wherein each contact switch present comprises a stator element and a tongue member mounted on the key rod or on the support frame, a first stator element and tongue member, being electrically insulated from ground and being connected to said operating circuit, and a second stator element and tongue member being grounded.

18. An actuating unit as described in claim 17 wherein said key rod is a permanent magnet, one pole of which is adjacent the connection of said key rod to the key and the other pole to said mounting of the key rod in the supporting frame, and said tongue member is swingably mounted in the zone of the last-mentioned pole on the key rod and has its own magnetism which is of opposite pole to the magnetism of the key rod, so that the free end of the tongue, in the rest position, forms a magnetic circuit with the key-adjacent pole of the key rod which magnetic circuit is closed through the connection of the tongue to the key rod mounting, said supporting frame comprising a stop element which limits the movement of the free end of the tongue towards the key-adjacent pole of the key rod, so that when the key is moved out of its rest position away from the tongue member, the latter cannot follow this movement whereby said magnetic circuit is broken and the magnetic force of attraction between the free end of the tongue and the key-adjacent pole on the key rod decreases rapidly.

19. A method of actuating a keyboard, actuatable with the aid of the tips of fingers of at least one hand, which keyboard comprises a support frame, a first row of key units, each of which comprises a key being movable out of an initial inoperative position in which the tips of the index finger, middle finger, ring finger and little finger, respectively, rest on the keys of said first row and a hand rest for the ball of the thumb or wrist of the said hand; the keys of said first row for each hand to be used for operating the keyboard being arranged on a curve, which corresponds to the natural disposition of the finger tips when the fingers are, without being tensioned, in a slightly curved and spread, but relaxed posture, wherein the key of each key unit of said guide key row has a key rod and a top face on one end of said key rod and destined for having the tip of a finger rest thereon, and, at the end of said rod opposite said top face, non-depressable mounting means articulatedly lodged in said support frame and being adapted for preventing downward depression of said key while permitting lateral shifting of said key toward at least one determined operational position, attracting means adjacent one side of said key, near the end of said key rod bearing said top face and facing away from said operational position, and adapted for exercising a determined initial attraction on said top face-bearing key rod end opposing tilting movement of said key away from said attracting means, when such movement is initiated by a finger tip resting on the top face of said key; stop means associated with said attracting means and preventing the latter from following said tilting movement of said key, thereby decreasing the attractive force of said attractive means as the distance of said key therefrom increases due to progress of said lateral tilting movement of said key, and thereby causing said finger tip to tilt said key automatically further until the latter is fully shifted to said operating position, and (a) resting the said ball of the thumb or wrist of said hand on said hand rest during actuation of the keyboard;

(b) exercising random vertical pressure by the finger tips on the top faces of the keys of said first row, (c) exercising tilting pressure by one finger tip on the top face of one of said keys toward one of the forward, rearward, right or left sides thereof, strong enough to overcome said initial attraction and tilting said key;

(d) after return of said key and the finger tip thereon to the rest position, exercising tilting pressure as described under (c) to the top surface of the same or another key of said keyboard.

* * * * *